US007523731B2

(12) United States Patent
Shimatsu

(10) Patent No.: US 7,523,731 B2
(45) **Date of Patent: *Apr. 28, 2009**

(54) INTAKE SYSTEM FOR INTERNAL COMBUSTION ENGINE

(75) Inventor: Takayuki Shimatsu, Tochigi-ken (JP)

(73) Assignee: Keihin Corporation, Shinjuku-Ku, Tokyo (JP)

( * ) Notice: Subject to any disclaimer, the term of this patent is extended or adjusted under 35 U.S.C. 154(b) by 317 days.

This patent is subject to a terminal disclaimer.

(21) Appl. No.: 11/109,816

(22) Filed: Apr. 20, 2005

(65) Prior Publication Data

US 2006/0065225 A1 Mar. 30, 2006

(30) Foreign Application Priority Data

Sep. 29, 2004 (JP) ..... 2004-284324
Sep. 29, 2004 (JP) ..... 2004-284336
Sep. 29, 2004 (JP) ..... 2004-284778
Sep. 29, 2004 (JP) ..... 2004-284797

(51) Int. Cl.
*F02M 35/10* (2006.01)
*F02B 23/00* (2006.01)

(52) U.S. Cl. ..... 123/184.55; 123/585

(58) Field of Classification Search ..... 123/184.21, 123/184.55, 184.35, 184.48, 585, 339, 184.42
See application file for complete search history.

(56) References Cited

U.S. PATENT DOCUMENTS 4,478,075 A 10/1984 Oyama et al.
4,577,495 A 3/1986 Bamer
5,002,021 A * 3/1991 Nakata et al. ..... 123/184.42
5,063,899 A * 11/1991 Hitomi et al. ..... 123/336
6,675,756 B2 * 1/2004 Katayama ..... 123/184.34
6,971,358 B2 * 12/2005 Shimatsu ..... 123/184.21
6,973,912 B1 * 12/2005 Shimatsu et al. ..... 123/339.1
2003/0070494 A1 4/2003 Kanke et al.
2004/0118376 A1 6/2004 Dohta

FOREIGN PATENT DOCUMENTS

JP 58-105013 6/1983
JP 60-239625 11/1985
JP 63-122233 8/1988
JP 01-130024 5/1989
JP 02-259248 10/1990
JP 3-233168 10/1997
JP 2887111 2/1999
JP 2001-82260 3/2001
JP 2002-364469 12/2002
JP 2003-120406 4/2003
JP 2004-190591 7/2004

* cited by examiner

*Primary Examiner*—Stephen K. Cronin
*Assistant Examiner*—Hyder Ali
(74) *Attorney, Agent, or Firm*—Squire Sanders & Dempsey, L.L.P.

(57) ABSTRACT

An intake manifold of an engine has a common pipe disposed downstream of a throttle valve, a plurality of first through fourth branch pipes connected to the common pipe, and a bypass pipe connected between the common pipe and the first through fourth branch pipes. The bypass pipe has a plurality of branches connected respectively to the first through fourth branch pipes. An amount of intake air flowing through the intake manifold is detected by an air flow meter disposed in the bypass pipe.

8 Claims, 23 Drawing Sheets

INTAKE SYSTEM FOR INTERNAL COMBUSTION ENGINE

BACKGROUND OF THE INVENTION

1. Field of the Invention

The present invention relates to an intake system for introducing intake air into an internal combustion engine, and more particularly to an intake system having an amount-of air detector for detecting an amount of intake air introduced into an internal combustion engine.

2. Description of the Related Art

Internal combustion engines that have been used on motor vehicles or the like have intake pipes for introducing intake air into the cylinders which provide combustion chambers and intake valves mounted in respective intake ports, to which the respective intake pipes are connected, for selectively bringing the cylinders into and out of fluid communication with the respective intake pipes. When the intake valves are opened, intake air is introduced through the intake pipes into the cylinders.

Intake pipes disclosed in Japanese Laid-Open Patent Publication No. 2004-190591, for example, are connected to a throttle valve for regulating the rate of intake air (amount of intake air) flowing through the intake pipes. The valve opening of the throttle valve is adjusted to regulate the amount of intake air introduced into the cylinders. An air flow sensor, for measuring or detecting the amount of intake air flowing through the intake pipes, is disposed upstream of the throttle valve. A surge tank is connected to the intake pipes downstream of a throttle body and has a pressure sensor for detecting the air pressure in the intake pipes.

A detected signal from the air flow sensor is output to a control circuit, which calculates the amount (mass or volume) of intake air introduced into the cylinders from the detected signal from the air flow sensor. Then, the control circuit calculates an optimum amount of fuel to be injected into the cylinders depending on the operating state of the internal combustion engine based on the calculated amount of intake air. The control circuit then outputs a control signal representing the calculated optimum amount of fuel to a fuel injector, thereby controlling operation of the fuel injector.

According to the above conventional intake system, when the throttle valve is quickly opened to rapidly accelerate the motor vehicle, intake air for filling the surge tank connected to the intake pipes that are under a negative pressure is introduced into the intake pipes, in addition to the intake air that is actually introduced into the cylinders. Therefore, the amount of intake air that is detected by the air flow sensor is the sum of intake air actually introduced into the cylinders and part of intake air filling the intake pipes.

The pressure sensor that is disposed downstream of the throttle valve separately from the air flow sensor detects the pressure of intake air in the intake pipes, and the control circuit estimates the amount of intake air filling the intake pipes. The control circuit is required to subtract the estimated amount of intake air from the total amount of intake air detected by the air flow sensor, thereby estimating the amount of intake air that is actually drawn into the cylinders for controlling the internal combustion engine.

With the above conventional intake system, however, the amount of intake air drawn into the cylinders is estimated based on the amount of intake air detected by the air flow sensor disposed upstream of the throttle body and the pressure detected by the pressure sensor. Consequently, the control system fails to accurately recognize the amount of intake air actually introduced into the cylinders, and finds it difficult to accurately control the amount of fuel injected into the cylinders based on the amount of intake air.

SUMMARY OF THE INVENTION

It is a general object of the present invention to provide an intake system for an internal combustion engine, which is capable of highly accurately detecting an amount of intake air to be introduced into cylinders of the internal combustion engine for thereby controlling the internal combustion engine highly accurately.

The above and other objects, features, and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
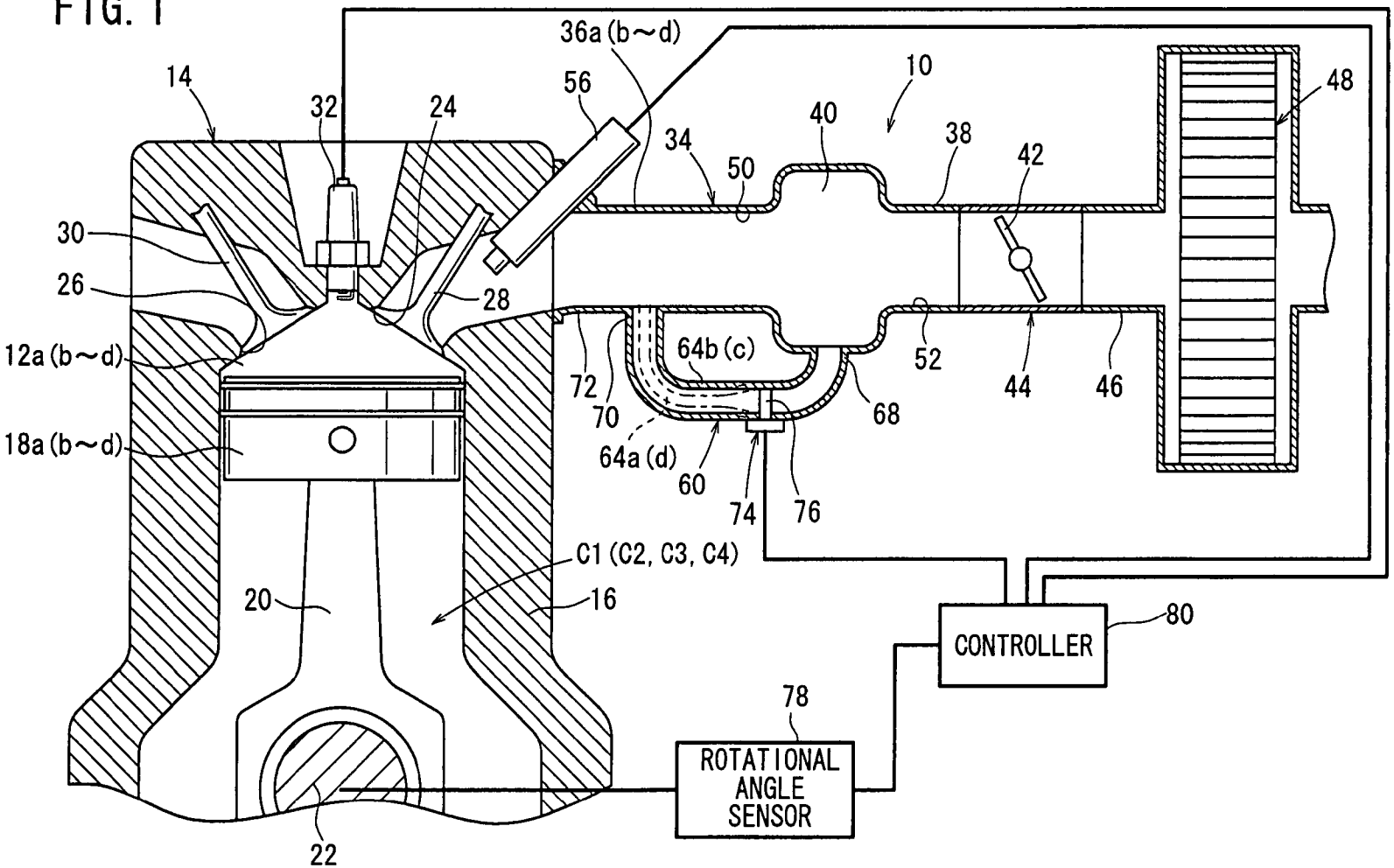
FIG. 1 is a schematic cross-sectional view, partly in block form, of an intake system for an internal combustion engine according to a first embodiment of the present invention.
Figure 2:
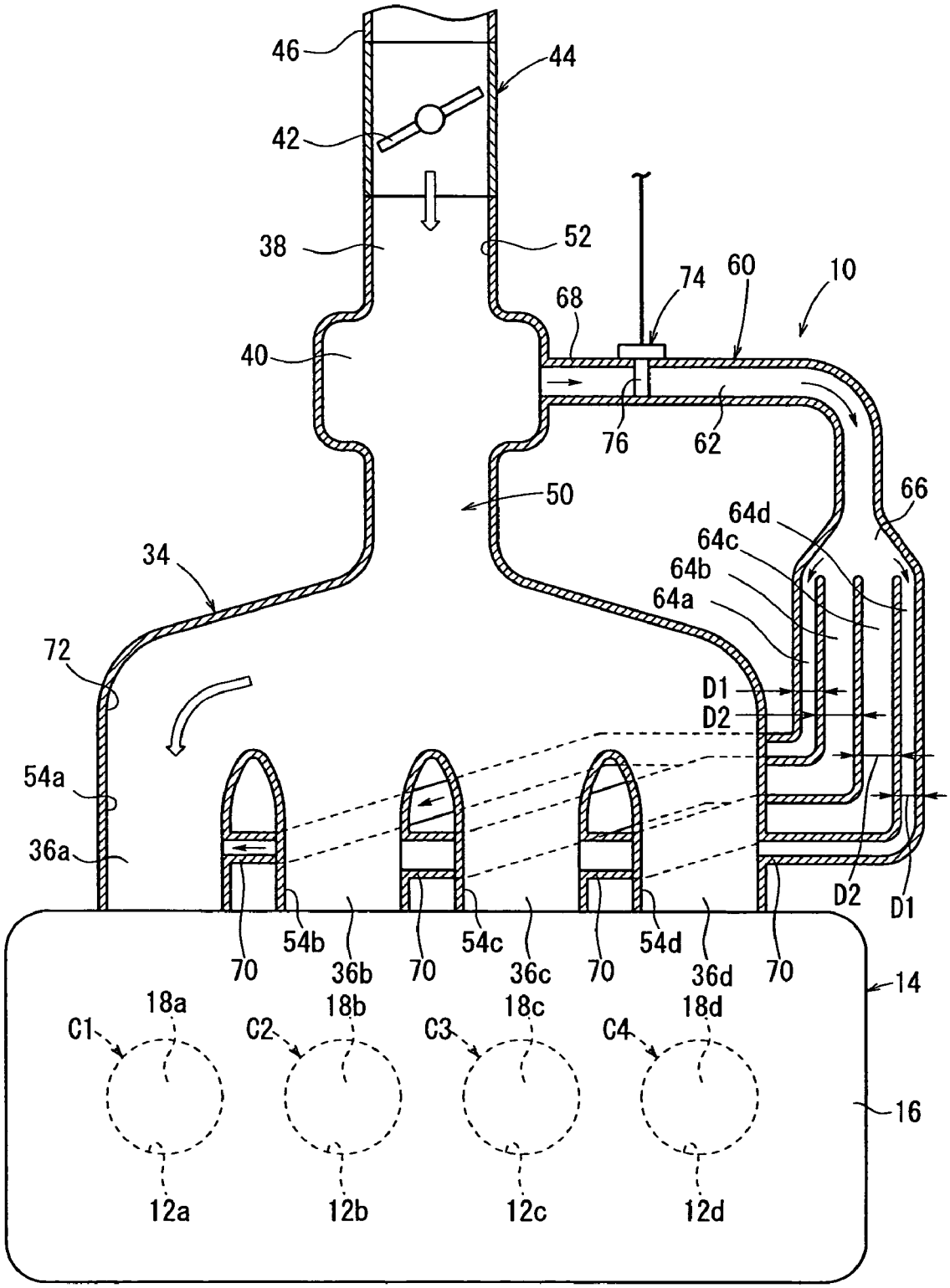
FIG. 2 is a horizontal cross-sectional view of a portion, including an intake manifold, of the intake system shown in FIG. 1.

FIG. 1 shows an intake system 10 for an internal combustion engine according to a first embodiment of the present invention. FIGS. 1 and 2 schematically show the intake system 10 for an internal combustion engine that is a multicylinder internal combustion engine having a plurality of cylinders.

The intake system 10 is combined with a multicylinder engine (internal combustion engine) 14 having, for example, four cylinders, i.e., first through fourth cylinder chambers 12*a* through 12*d* (see FIG. 2), for use on a motor vehicle, e.g., an automobile, a motorcycle, or the like.

As shown in FIGS. 1 and 2, the engine 14 has first through fourth pistons 18*a* through 18*d* (see FIG. 2) displaceably disposed in an axial direction respectively in the first through fourth cylinder chambers 12*a* through 12*d* that are defined in an engine body (main body) 16. When the first through fourth pistons 18*a* through 18*d* are displaced in their stroke, they change the volumes of the respective first through fourth cylinder chambers 12*a* through 12*d* to cause the engine 14 to operate in intake, compression, power, and exhaust strokes.

Displacement of the first through fourth pistons 18*a* through 18*d* is output as drive power from the engine 14, from the first through fourth pistons 18*a* through 18*d* through connecting rods 20 and a crankshaft 22. The first through fourth pistons 18*a* through 18*d* and the first through fourth cylinder chambers 12*a* through 12*d* respectively define a first cylinder C1, a second cylinder C2, a third cylinder C3, and a fourth cylinder C4 (see FIG. 2).

The engine body 16 has intake ports 24 and exhaust ports 26 defined therein. The intake ports 24 are open into the respective first through fourth cylinder chambers 12*a* through 12*d*, and the exhaust ports 26 are open into the respective first through fourth cylinder chambers 12*a* through 12*d*. Intake valves 28 are operatively disposed in the respective intake ports 24, and exhaust valves 30 are operatively disposed in the respective exhaust ports 26. Spark plugs 32 are disposed in the engine body 16 in the upper ends of the respective first through fourth cylinder chambers 12*a* through 12*d* between the intake ports 24 and the exhaust ports 26.

The intake ports 24 that are open into the respective first through fourth cylinder chambers 12*a* through 12*d* are connected respectively to first through fourth branch pipes 36*a* through 36*d* (see FIG. 2) of an intake manifold 34.

The intake manifold 34 has the first through fourth branch pipes 36*a* through 36*d* that are branched downstream, a common pipe 38 extending upstream of the first through fourth branch pipes 36*a* through 36*d*, and a tank 40 interconnecting the first through fourth branch pipes 36*a* through 36*d* and the common pipe 38 and having a predetermined volume.

A throttle body 44 including a throttle valve 42 that can be opened and closed in co-operated relation to an accelerator pedal (not shown) is disposed upstream of the common pipe 38. An air cleaner 48 (see FIG. 1) is disposed upstream of and connected to the throttle body 44 by an intake pipe 46. Intake air is introduced through the air cleaner 48 into the intake manifold 34. At this time, the air cleaner 48 removes dust particles from the intake air as it passes through the air cleaner 48.

Figure 3:
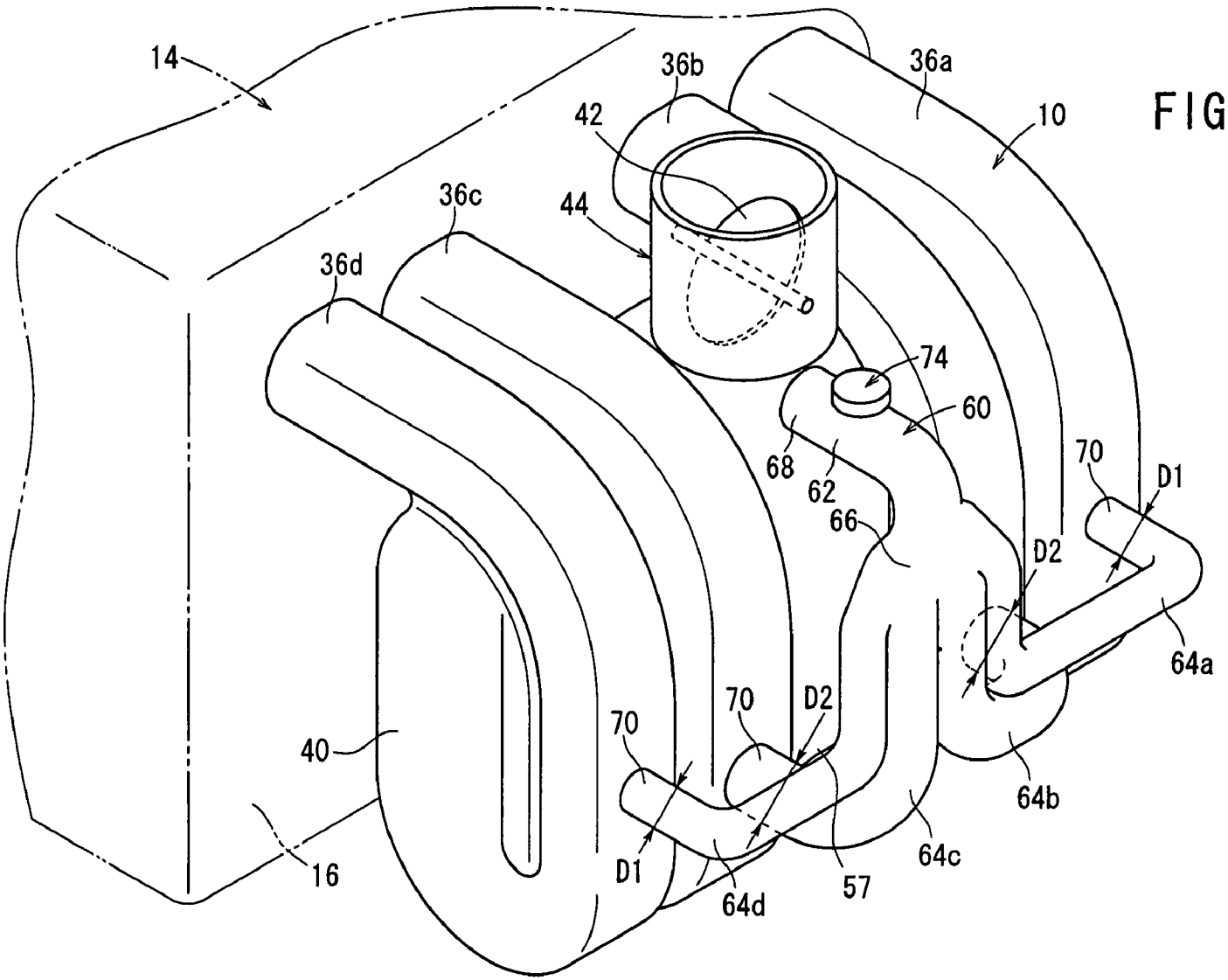
FIG. 3 is a perspective view of the intake manifold of the intake system shown in FIG. 1.
Figure 5:
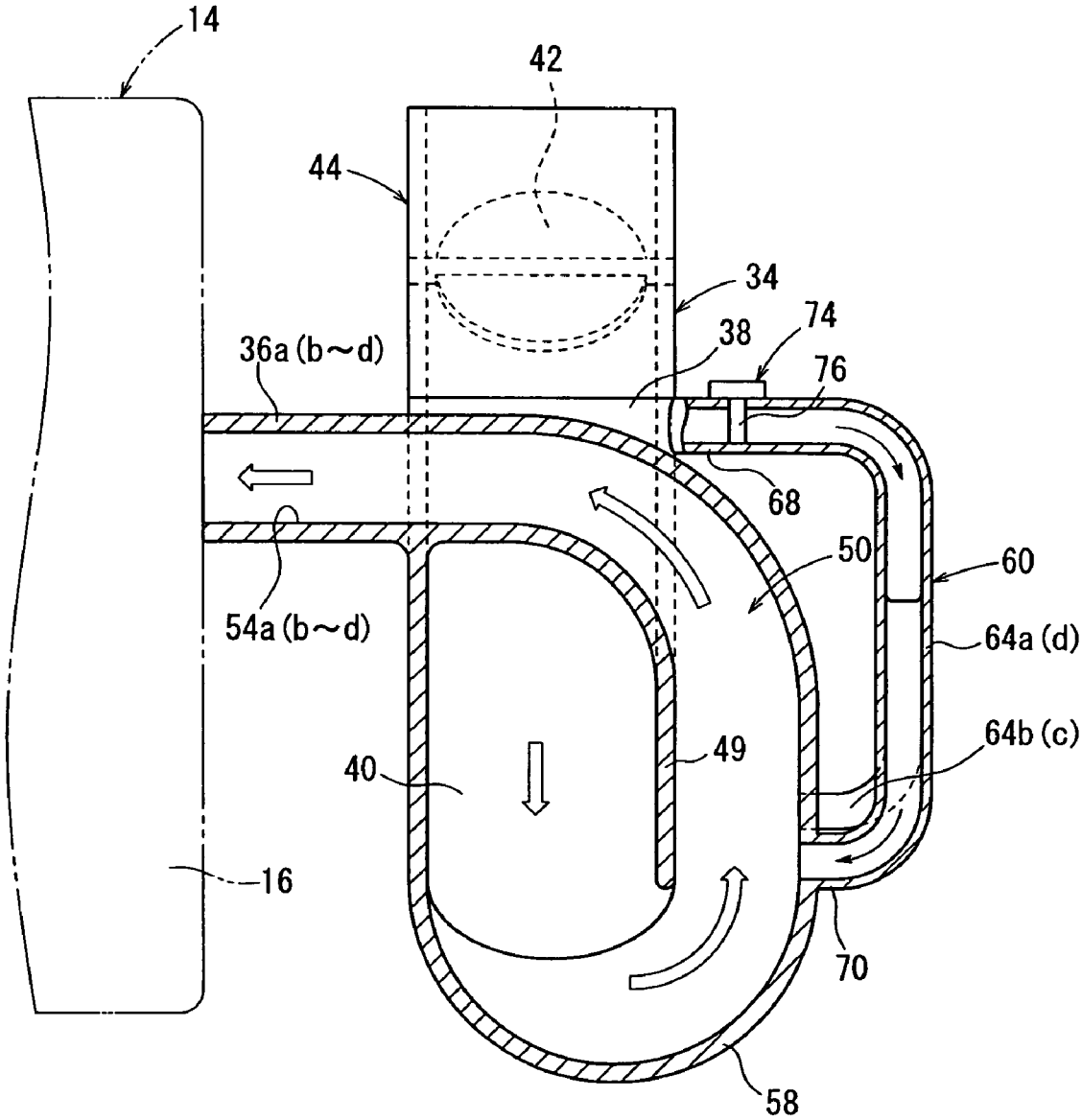
FIG. 5 is a vertical cross-sectional view of the intake system shown in FIG. 3.

Structural details of the intake manifold 34 will be described below with reference to FIGS. 3 and 5. The intake manifold 34 is of a down-draft type wherein the common pipe 38 and the first through fourth branch pipes 36*a* through 36*d* extend parallel to each other.

The common pipe 38, which is in the form of a substantially cylindrical tube, is positioned centrally in the intake manifold 34, and is joined to the tank 40, which is of a substantially rectangular shape, that has an increased width in a direction substantially perpendicular to the axis of the common pipe 38. As shown in FIG. 5, the first through fourth branch pipes 36*a* through 36*d* connected to the tank 40 extend a predetermined distance toward the common pipe 38 along a partition wall 49 between themselves and the tank 40, and then are curved to extend toward the engine body 16 in a direction substantially perpendicular to the axis of the common pipe 38.

The intake manifold 34 has an intake passage (main intake passage) 50 defined therein, through which intake air flows. The intake passage 50 comprises a common passage 52 defined in the common pipe 38 and a plurality of branch passages 54*a* through 54*d* (see FIG. 2) defined respectively in the first through fourth branch pipes 36*a* through 36*d*. Injectors 56 (see FIG. 1), which function as fuel injection valves, are disposed in the portions of the first through fourth branch pipes 36*a* through 36*d* that are joined to the intake ports 24, in confronting relation to the intake ports 24. The injectors 56 inject fuel into the branch passages 54*a* through 54*d*, under the control of an electric signal supplied from a controller 80 (see FIG. 1).

Figure 4:
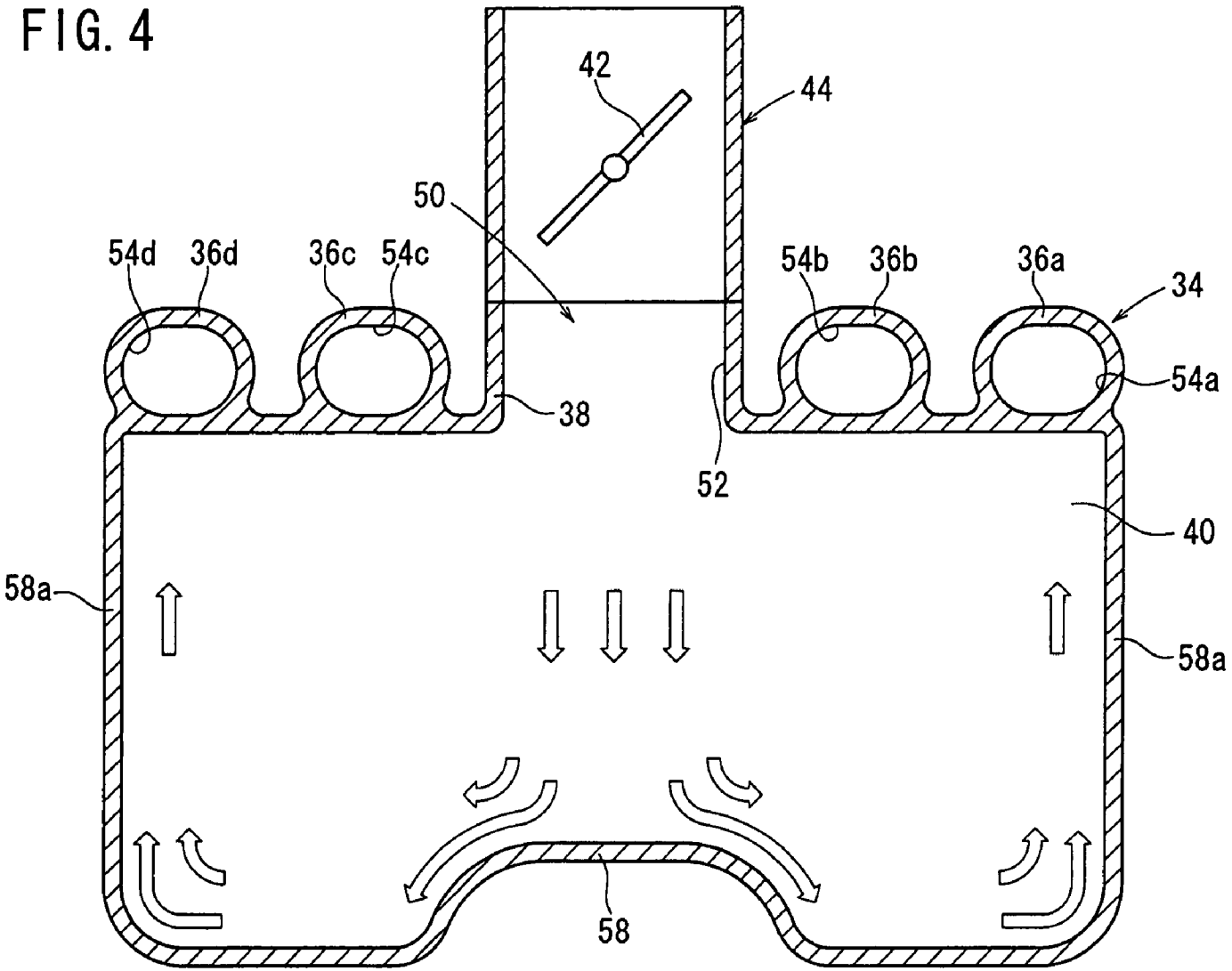
FIG. 4 is a vertical cross-sectional view of the intake manifold shown in FIG. 3.

Specifically, when intake air is introduced from the air cleaner 48 into the intake manifold 34, it flows from the common pipe 38 through the common passage 52 into the tank 40 as the throttle valve 42 is opened. The intake air temporarily fills the tank 40, and then is distributed from the tank 40 into the first through fourth branch pipes 36*a* through 36*d*. As shown in FIG. 4, when the intake air flows from the common pipe 38 into the tank 40, the intake air hits a guide wall surface 58 of the tank 40 which confronts the common pipe 38, and flows along opposite side walls 58*a* of the tank 40.

During the compression, power, and exhaust strokes, other than the intake stroke, of the engine 14, when the intake air is introduced from the common pipe 38 into the tank 40, the pressure of the intake air near the side walls 58*a* of the tank 40 is higher than the pressure in regions of the tank 40 spaced from the side walls 58*a*, and the intake air flows faster near the side walls 58*a*.

Stated otherwise, since the first and fourth branch pipes 36*a*, 36*d* are disposed adjacent to the side walls 58*a* of the tank 40 which are substantially parallel to the axis of the common pipe 38, the pressure in and near the first and fourth branch pipes 36*a*, 36*d* is higher. The pressure in the second and third branch pipes 36*b*, 36*c* that are disposed centrally in the intake manifold 34 and spaced from the side walls 58*a* is lower than the pressure in and near the first and fourth branch pipes 36*a*, 36*d*.

As shown in FIGS. 1 and 2, a bypass pipe (auxiliary intake passage) 60 for bypassing the manifold section between the tank 40 or the common pipe 38 and the first through fourth branch pipes 36*a* through 36*d* is connected to the intake manifold 34.

The bypass pipe 60 has an upstream inlet 62 connected to the tank 40 or the common pipe 38, a plurality of downstream branches 64*a* through 64*d* associated with and connected to the respective first through fourth branch pipes 36*a* through 36*d*, and a common joint 66 joining the branches 64*a* through 64*d* to the inlet 62.

The bypass pipe 60 has a first connecting end 68 on its inlet 62 which is connected to the tank 40 or the common pipe 38, holding the bypass pipe 60 and the common passage 52 in fluid communication with each other.

The branches 64*a* through 64*d* on the other end of the bypass pipe 60 are connected respectively to the first through fourth branch pipes 36*a* through 36*d*, as shown in FIG. 2. The branches 64*a*, 64*d* that are connected respectively to the first and fourth branch pipes 36*a*, 36*d* are thinner, i.e., smaller in diameter, than the branches 64*b*, 64*c* that are connected respectively to the second and third branch pipes 36*b*, 36*c*. That is, the pipe diameter D1 of the branches 64*a*, 64*d* is smaller than the pipe diameter D2 of the branches 64*b*, 64*c* (D1<D2). The branches 64*b*, 64*c* are of substantially the same diameter as each other, and the branches 64*a*, 64*d* are of substantially the same diameter as each other.

The bypass pipe 60 has second connecting ends 70 on its branches 64*a* through 64*d* which are connected to pipe walls 72 of the first through fourth branch pipes 36*a* through 36*d* of the intake manifold 34, respectively, holding the bypass pipe 60 and the branch passages 54*a* through 54*d* in fluid communication with each other. The inlet 62 and the branches 64*a* through 64*d* of the bypass pipe 60 are thinner, i.e., smaller in diameter, than the common pipe 38 and the first through fourth branch pipes 36*a* through 36*d* of the intake manifold 34.

The upstream first connecting end 68 of the bypass pipe 60 is not necessarily connected to the tank 40 or the common pipe 38, but may directly be connected to the intake manifold 34 near the throttle body 44. The downstream second connecting ends 70 of the bypass pipe 60 may be connected to the engine body 16 downstream of the intake manifold 34.

An air flow meter (amount-of-air detector) 74, for detecting an amount of intake air flowing through the bypass pipe 60, is disposed in the inlet 62 of the bypass pipe 60. The air flow meter 74, which functions as an amount-of-air detector, is located at a position where intake air flows in a stable laminar flow through the bypass pipe 60. The air flow meter 74 may be disposed in the joint 66 of the bypass pipe 60, rather than the inlet 62 thereof. That is, the air flow meter 74 may be disposed in a position where the intake air flows in a stable laminar flow through the bypass pipe 60, allowing the air flow meter 74 to reliably detect an amount of intake air flowing through the bypass pipe 60.

The air flow meter 74 has a detecting element 76 that may comprise a silicon chip with a thin film of platinum evaporated thereon, for example. When intake air flows around the detecting element 76, the detecting element 76, which is controlled so as to maintain a constant temperature, changes in temperature, causing a change in the amount of current that is supplied to the detecting element 76 for keeping the temperature thereof constant. The air flow meter 74 may be a hot-wire type, which detects the change in the amount of supplied current, thereby detecting the amount of intake air flowing through the bypass pipe 60.

The air flow meter 74 is not necessarily a hot-wire type, but alternatively may be of any of other various types of air flow meters. For example, the air flow meter 74 may be a Karman vortex type, for detecting a volumetric amount of intake air flowing through the bypass pipe 60 by detecting vortexes generated downstream of a resistive member that is disposed in the bypass pipe 60 as a flow resistance member, or the air flow meter 74 may be a flap type, for detecting a volumetric amount of intake air flowing through the bypass pipe 60 by detecting an angular displacement of a flap that is pushed by intake air flowing through the bypass pipe 60.

The intake system 10 according to the first embodiment of the present invention is basically constructed as described above. Control operations and advantages of the intake system 10 will be described below.

With the engine 14 started, the driver of the motor vehicle depresses the accelerator pedal (not shown) to open the throttle valve 42. In the intake stroke, where the intake valves 28 are lifted off the valve seats in the intake ports 24 and the first through fourth pistons 18*a* through 18*d* are successively displaced downwardly, intake air is introduced from the air cleaner 48 (see FIG. 1) into the intake manifold 34, under an intake negative pressure developed in the first through fourth cylinder chambers 12*a* through 12*d*.

A portion of the intake air that is introduced through the throttle valve 42 into the intake passage 50 is introduced through the tank 40 from the first connecting end 68 into the inlet 62. At this time, the air flow meter 74 on the bypass pipe 60 detects the amount of intake air, which flows in a stable laminar flow through the bypass pipe 60.

The angular displacement of the crankshaft 22, or alternatively a camshaft of the engine 14, is detected by a rotational angle sensor 78, which outputs a detected signal to the controller 80. Based on the detected signal from the rotational angle sensor 78, the controller 80 identifies which one of the first through fourth cylinders C1 through C4 is presently in an intake stroke.

Stated otherwise, the controller 80 confirms which of the first through fourth cylinders C1 through C4 is supplied with the intake air, based on the detected signals from the rotational angle sensor 78 and the air flow meter 74. Accordingly, the amount of intake air drawn into each of the first through fourth cylinder chambers 12*a* through 12*d* can be detected using a single air flow meter 74.

For example, when the first cylinder C1 is in the intake stroke, the intake air flows into the branch passage 54*a* in the first branch pipe 36*a* that is connected to the first cylinder chamber 12*a* as the first piston 18*a* is displaced in its stroke, as shown in FIG. 2. A portion of the intake air which is introduced into the bypass pipe 60 flows into the branch 64*a* after the amount thereof is detected by the air flow meter 74. Then, the intake air flows from the bypass pipe 60 into the branch passage 54*a* of the intake manifold 34 where it is combined with the intake air flowing through the branch passage 54*a*, after which the combined intake air flows from the branch passage 54*a* into first cylinder chamber 12*a*.

Figure 6:
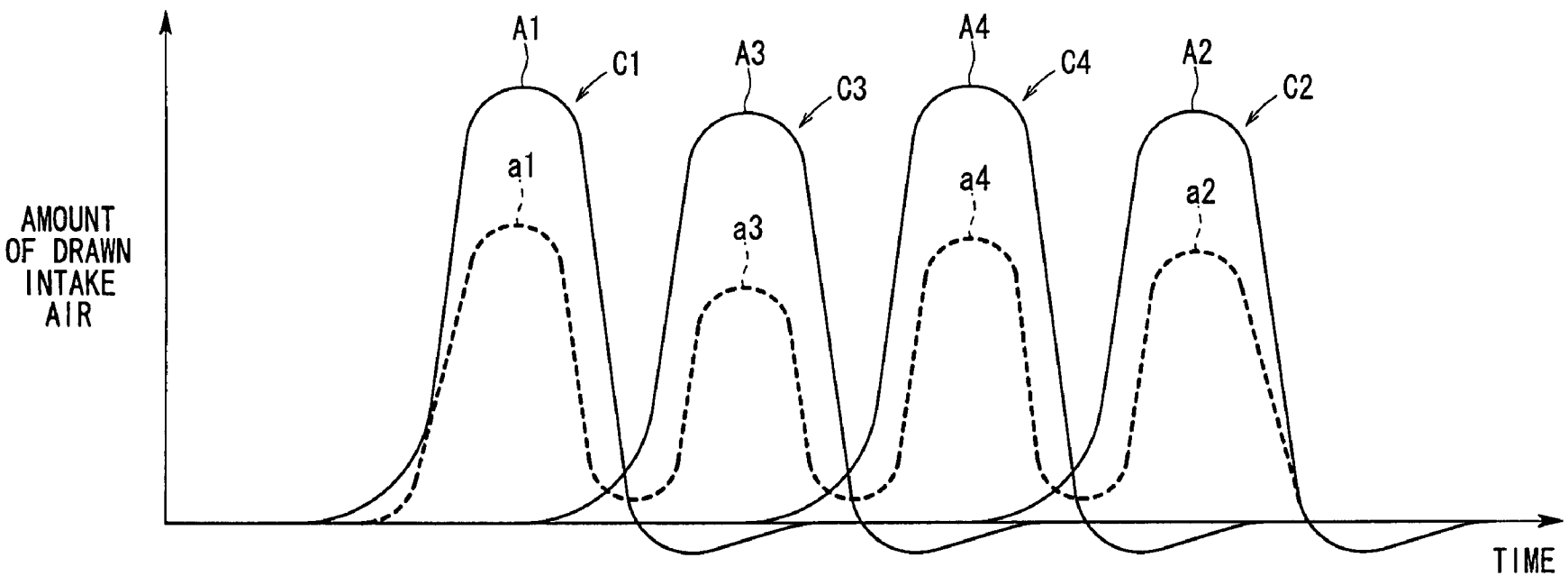
FIG. 6 is a diagram showing the relationship between amounts of intake air introduced into first through fourth cylinders, respectively, amounts of intake air detected by an air flow meter, and time.
Figure 7:
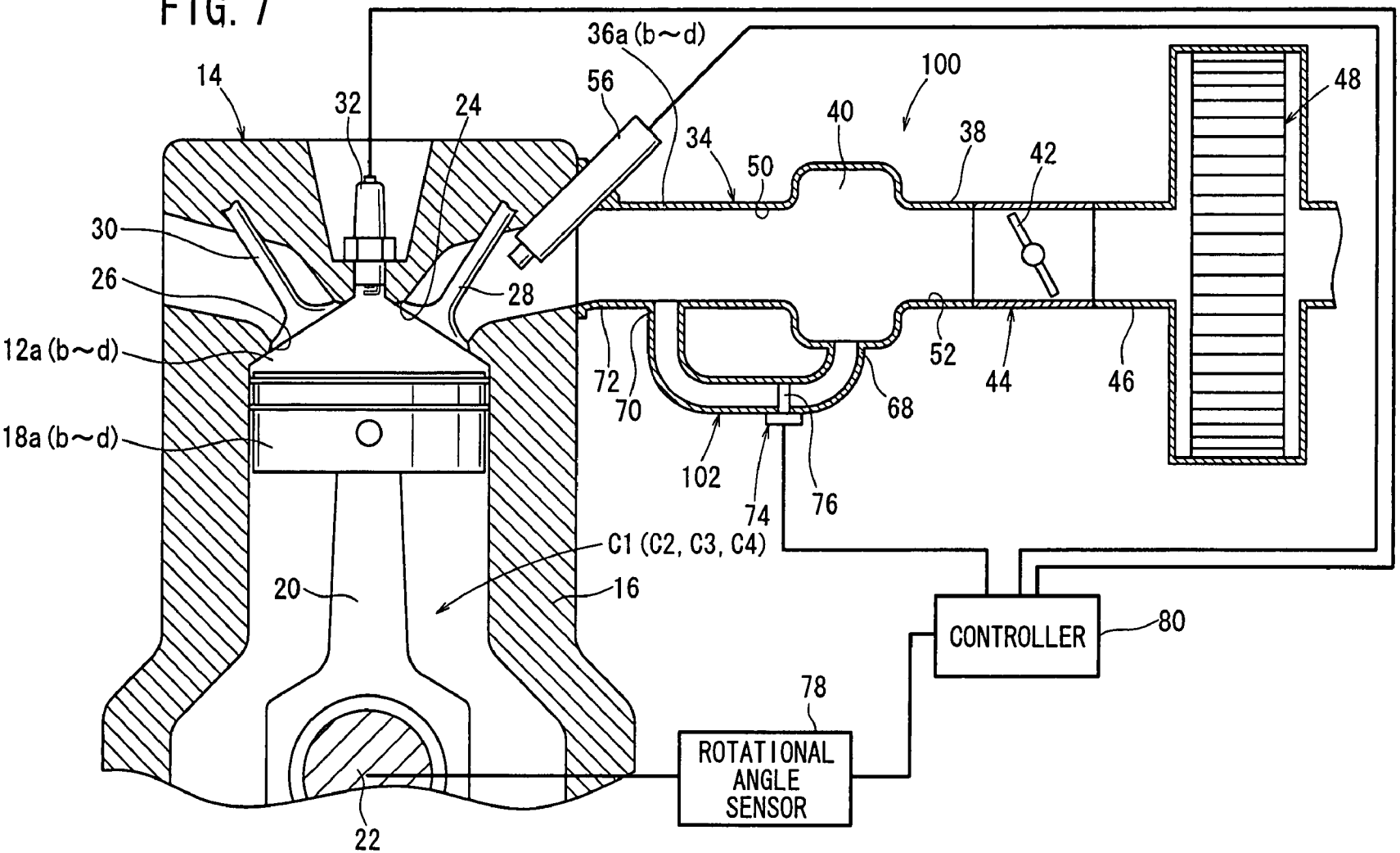
FIG. 7 is a schematic cross-sectional view, partly in block form, of an intake system for an internal combustion engine according to a second embodiment of the present invention.
Figure 8:
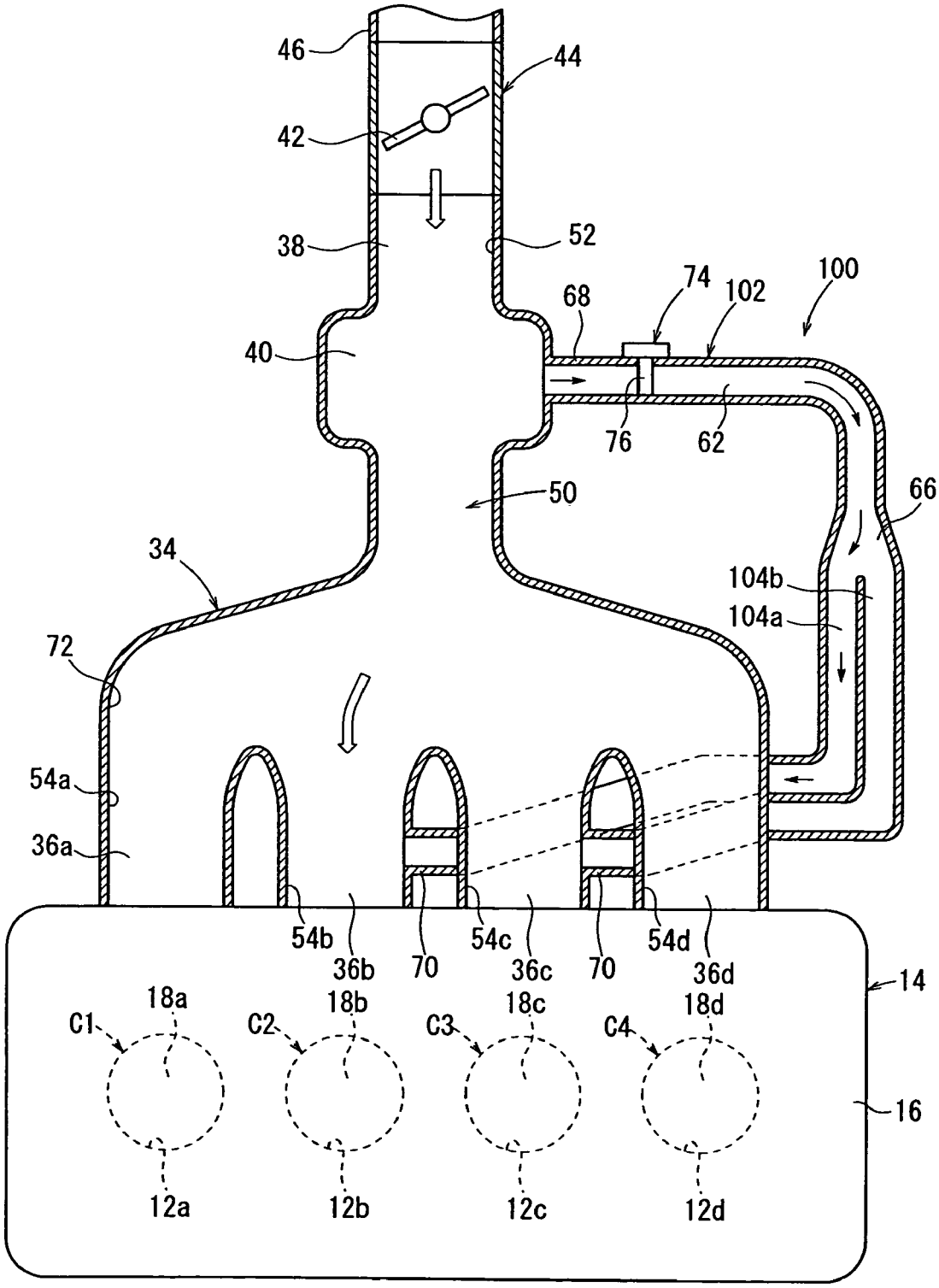
FIG. 8 is a horizontal cross-sectional view of a portion, including an intake manifold, of the intake system shown in FIG. 7.
Figure 9:
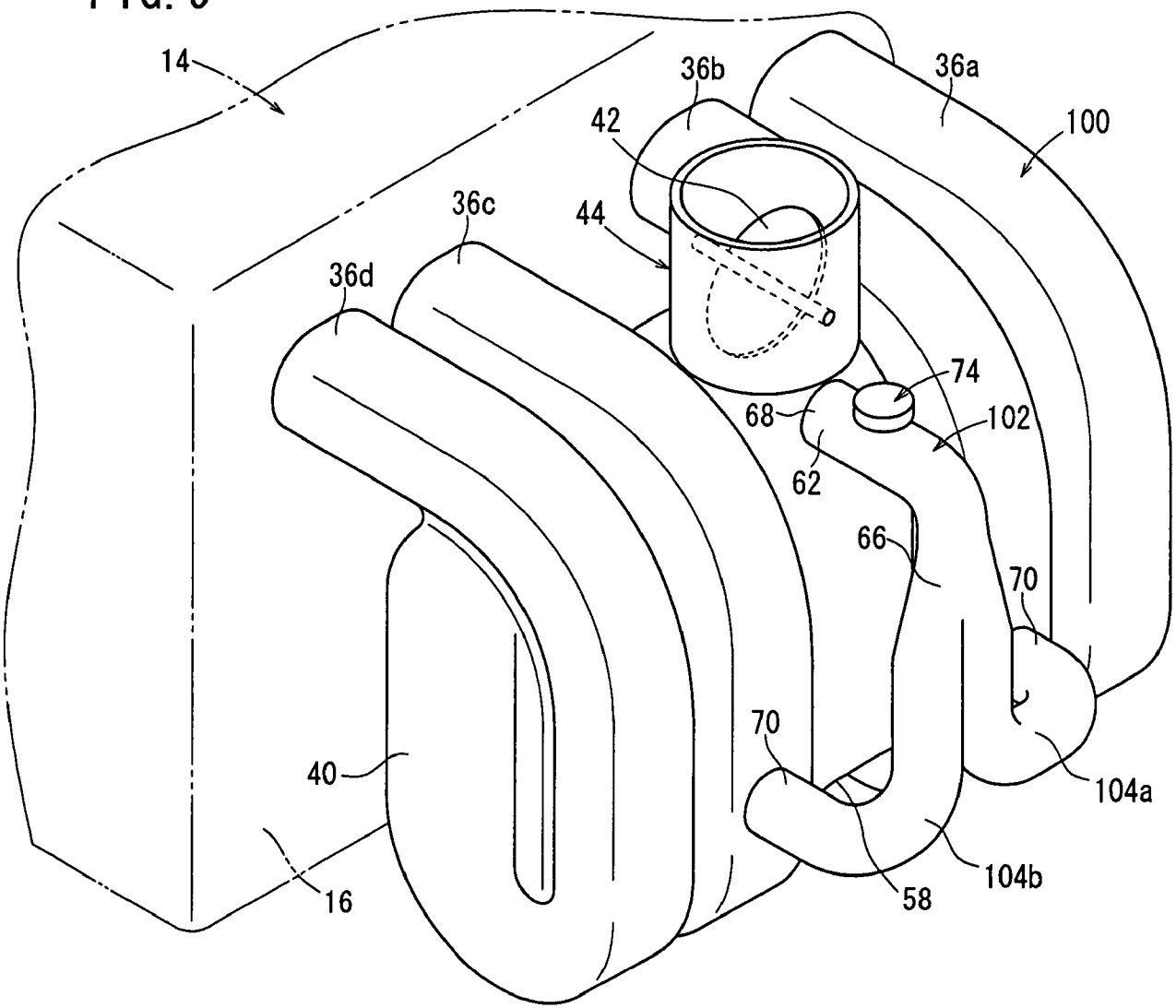
FIG. 9 is a perspective view of the intake manifold of the intake system shown in FIG. 7.
Figure 10:
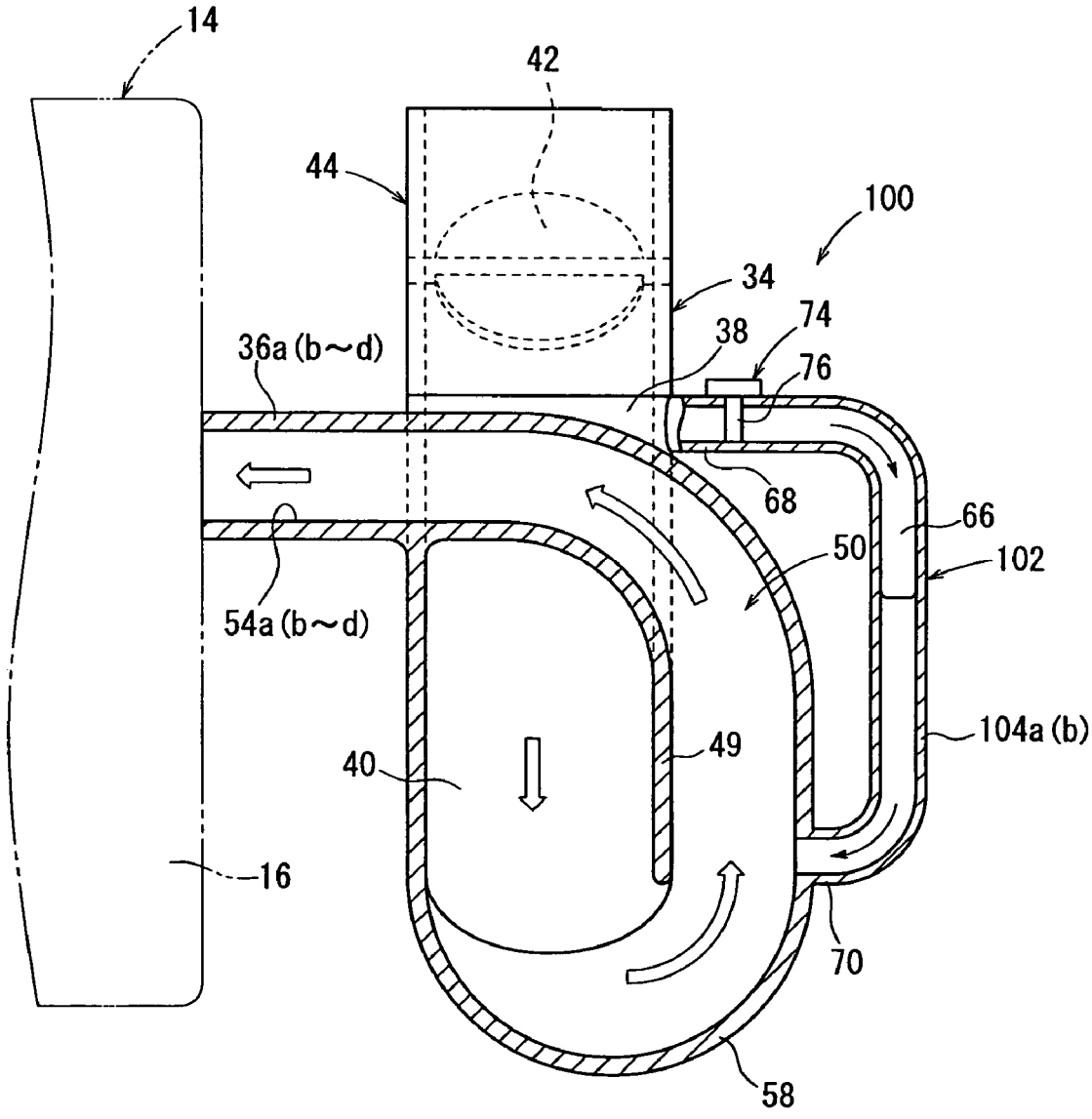
FIG. 10 is a vertical cross-sectional view of the intake system shown in FIG. 9.

As shown in FIG. 6, the air flow meter 74 outputs a detected value a1, which represents the amount of the intake air flowing through the bypass pipe 60, to the controller 80 (see FIG. 1), and based on the detected value a1, the controller 80 calculates the actual amount A1 of intake air flowing into the first branch pipe 36*a* while also calculating an optimum amount of fuel to be injected with respect to the amount A1 of intake air. The controller 80 applies a control signal based on the calculated optimum amount of fuel to be injected to the injector 56.

The injector 56 injects the calculated amount of fuel into the intake air flowing through the branch passage 54*a* in the first branch pipe 36*a* near the intake port 24. The mixture of the fuel and the intake air is then introduced into the first cylinder chamber 12*a*. FIG. 6 shows the relationship between amounts A1 through A4 of intake air introduced into the first through fourth cylinders C1 through C4, respectively, and amounts a1 through a4 of intake air detected by the air flow meter 74, per unit time.

When the third piston 18*c* in the third cylinder C3, for example, is then displaced, intake air is drawn through the third branch pipe 36*c* into the third cylinder chamber 12*c*, and the rotational angle sensor 78 (see FIG. 1) confirms that intake air is drawn into the third cylinder chamber 12*c*. Based on a detected value a3 from the air flow meter 74, the controller 80 calculates the actual amount A3 of intake air introduced into the third cylinder chamber 12*c*, and the injector 56 disposed in the third branch pipe 36*c* injects into the intake air an amount of fuel based on the amount A3 of intake air.

When the first through fourth pistons 18*a* through 18*d* are successively displaced into the intake stroke in the respective first through fourth cylinder chambers 12*a* through 12*d*, a negative intake pressure is developed, introducing intake air from the throttle valve 42 into the intake manifold 34. The intake air then flows into either one of the first through fourth branch pipes 36*a* through 36*d* of the intake manifold 34 that are connected to the first through fourth cylinders C1 through C4 in the intake stroke. At the same time, when a portion of the intake air flows into the bypass pipe 60 connected to the intake manifold 34, the air flow meter 74 detects the amount of intake air flowing through the bypass pipe 60.

The controller 80 determines which one of the first through fourth cylinders C1 through C4 is presently in the intake stroke based on a detected signal from the rotational angle sensor 78, making it possible to confirm which one of the first through fourth cylinder chambers 12*a* through 12*d* the amount of intake air detected by the air flow meter 74 is drawn into.

The intake stroke of each of the second and fourth cylinders C2, C4 is the same as the above intake stroke of the first and third cylinders C1, C3, and shall not be described in detail below.

Finally, the controller 80 determines which one of the first through fourth cylinder chambers 12*a* through 12*d* in the intake stroke intake air is drawn into based on a detected signal from the rotational angle sensor 78, and the injector 56 injects fuel into the intake air near the intake port 24. The mixture of the fuel injected from the injector 56 and the intake air is introduced into one of the first through fourth cylinder chambers 12*a* through 12*d* which is in the intake stroke.

In the above description, the bypass pipe 60 is connected to the intake manifold 34 of the four-cylinder engine which has the four branch pipes, i.e., the first through fourth branch pipes 36*a* through 36*d*. However, the number of branch pipes and the number of engine cylinders are not limited to any values. In the intake system 10, the smaller-diameter branches 64*a*, 64*d* of the bypass pipe 60 may be connected to the branch pipes 36*a*, 36*d* that are disposed adjacent to the side walls 58*a* of the tank 40 and disposed on the opposite ends of the intake manifold 34, and the branches 64*b*, 64*c* which are larger in diameter than the smaller-diameter branches 64*a*, 64*d* may be connected to the branch pipes 36*b*, 36*c* that are disposed centrally in the intake manifold 34 which are spaced from the side walls 58*a* of the tank 40.

The intake manifold 34 incorporated in the intake system 10 is not necessary a down-draft type described above, but may be a side-draft type wherein the common pipe and the branch pipes extend in a direction substantially perpendicular to each other.

According to the first embodiment, as described above, in the multicylinder engine 14 having the first through fourth cylinder chambers 12*a* through 12*d*, the bypass pipe 60 is connected between the common pipe 38 and the first through fourth branch pipes 36*a* through 36*d* of the intake manifold 34 that is connected to the engine 14. The bypass pipe 60 is in fluid communication with the intake passage 50 in the intake manifold 34, and combined with the air flow meter 74 for measuring an amount of intake air flowing through the bypass pipe 60.

When the intake air flows from the common pipe 38 into the tank 40, the intake air hits a guide wall surface 58 of the tank 40 which confronts the common pipe 38. The intake air then flows from the guide wall surface 58 along the opposite side walls 58*a* of the tank 40, and may flow into the first and fourth branch pipes 36*a*, 36*d* that are positioned adjacent to the side walls 58*a*.

When the intake air flows along the side walls 58*a* into the first and fourth branch pipes 36*a*, 36*d*, the intake air is prevented from entering the bypass pipe 60 because of the smaller-diameter branches 64*a*, 64*d*.

The second and third branch pipes 36*b*, 36*c* are disposed centrally in the intake manifold 34 and spaced predetermined distances from the side walls 58*a* of the tank 40. Therefore, the intake air flowing along the side walls 58*a* does not flow from the tank 40 into the second and third branch pipes 36*b*, 36*c*.

The intake air does not flow from the branches 64*b*, 64*c* connected to the second and third branch pipes 36*b*, 36*c* back into the bypass pipe 60. Stated otherwise, no intake air flows back from the tank 40 into the branches 64*b*, 64*c* connected to the second and third branch pipes 36*b*, 36*c*. Therefore, the pipe diameter D2 of the branches 64*b*, 64*c* does not need to be reduced, and may be larger than the pipe diameter D1 of the branches 64*a*, 64*d* that are connected to the first and fourth branch pipes 36*a*, 36*d*.

Because the pipe diameter D1 of the branches 64*a*, 64*d* is smaller than the pipe diameter D2 of the branches 64*b*, 64*c* that are connected to the second and third branch pipes 36*b*, 36*c* (D1<D2), the intake air is prevented from flowing from the tank 40 back into the bypass pipe 60. Consequently, the air flow meter 74 is prevented from erroneously detecting an amount of intake air flowing through the branches 64*a* through 64*d* back into the bypass pipe 60. As a result, the air flow meter 74 highly accurately detects only a forward flow of intake air flowing downstream through the bypass pipe 60.

Since the amounts of intake air that are actually drawn into the first through fourth cylinder chambers 12*a* through 12*d* can highly accurately be detected based on the detected result from the air flow meter 74, the amount of fuel to be injected can be controlled highly accurately based on the detected amounts of intake air. It is thus possible to optimize the air-fuel ratio which is the ratio of the intake air drawn into the first through fourth cylinder chambers 12*a* through 12*d* to the amount of fuel to be injected into the intake air. The engine 14 can be controlled highly accurately in real-time based on the amount of intake air and the amount of fuel to be injected.

Unburned gases produced in the first through fourth cylinder chambers 12*a* through 12*d* tend to find their way through the intake port 24 into the first and fourth branch pipes 36*a*, 36*d* when the intake valves 28 are opened, and exhaust gases discharged from the first through fourth cylinder chambers

12*a* through 12*d* partially flow back into the first and fourth branch pipes 36*a*, 36*d* for exhaust gas recirculation. However, those unburned gases and exhaust gases are prevented from flowing back from the first and fourth branch pipes 36*a*, 36*d* through the bypass pipe 60, the detecting element 76 of the air flow meter 74, which is disposed in the bypass pipe 60, is prevented from becoming contaminated by unburned gases and exhaust gases, and hence the detection accuracy of the air flow meter 74 for detecting the amount of intake air is prevented from being lowered.

FIGS. 7 through 10 show an intake system 100 according to a second embodiment of the present invention. Those parts of the intake system 100 which are identical to those of the intake system 10 according to the first embodiment are denoted by identical reference characters, and such features shall not be described in detail below.

The intake system 100 according to the second embodiment differs from the intake system 10 according to the first embodiment in that branches 104*a*, 104*b* of a bypass pipe 102 are connected to only the second and third branch pipes 36*b*, 36*c* which are disposed centrally in the intake manifold 34.

The bypass pipe 102 has an upstream inlet 62 connected to the tank 40 or the common pipe 38, a pair of downstream branches 104*a*, 104*b* provided as bifurcated pipe members associated with and connected to the respective second and third branch pipes 36*b*, 36*c*, and a common joint 66 joining the branches 104*a*, 104*b* to the inlet 62.

The branches 104*a*, 104*b* have second connecting ends 70 connected respectively to pipe walls 72 of the second and third branch pipes 36*b*, 36*c* of the intake manifold 34, holding the bypass pipe 102 and the branch passages 54*b*, 54*c* in the second and third branch pipes 36*b*, 36*c* in fluid communication with each other.

An air flow meter (amount-of-air detector) 74 for detecting an amount of intake air flowing through the bypass pipe 102 is disposed in the inlet 62 of the bypass pipe 102.

Figure 11:
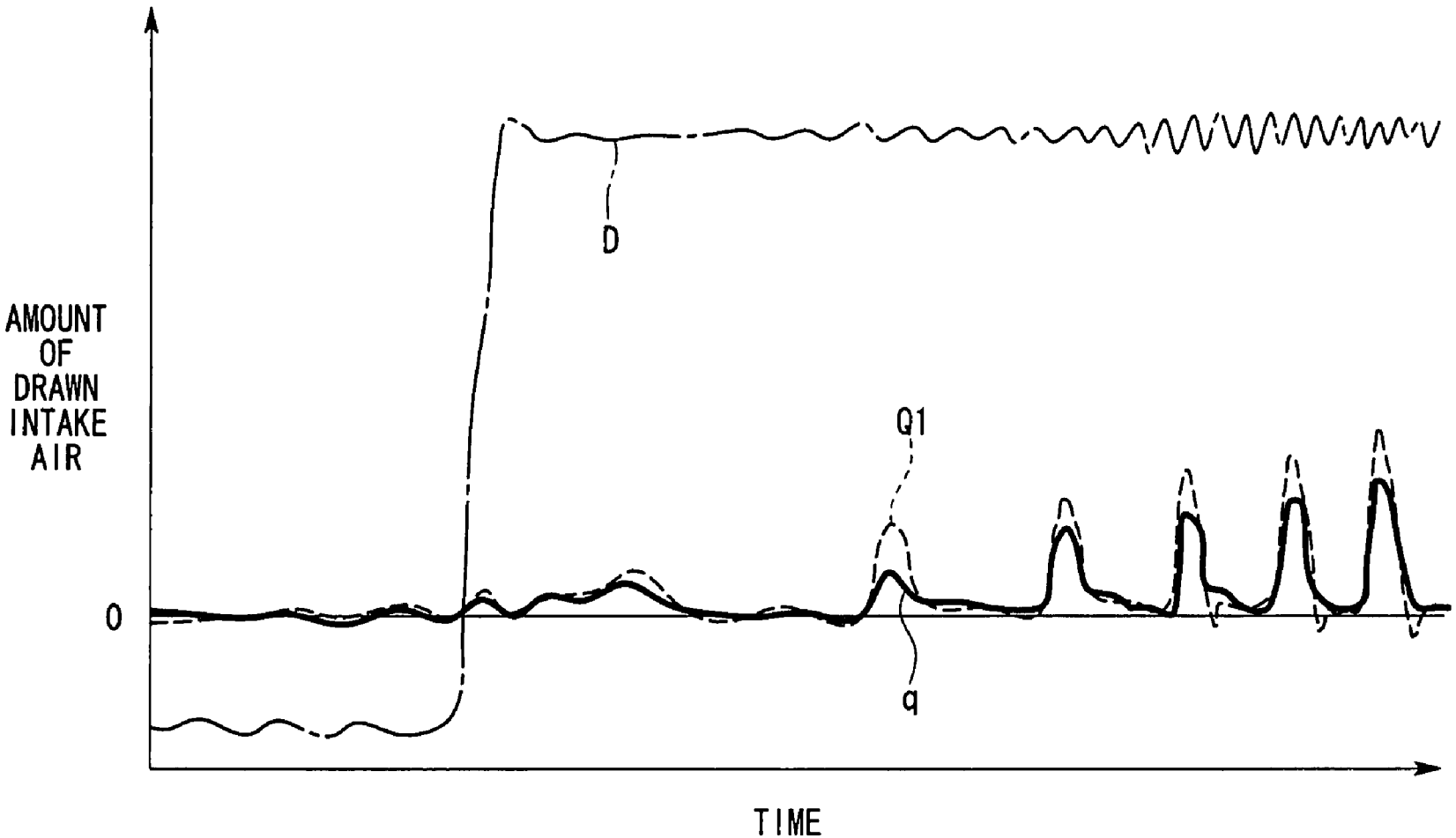
FIG. 11 is a diagram showing the relationship between an amount of intake air introduced into a second cylinder of the internal combustion engine and time.

The relationship between an amount of intake air drawn into the engine by the intake system 100 and time will be described below with reference to FIG. 11. FIG. 11 shows the relationship between an amount Q1 of intake air that is actually introduced into the second cylinder C2, and an amount q of intake air detected by the air flow meter 74, per unit time, when the opening of the throttle valve 42 is rapidly increased in order to increase the engine output power. FIG. 11 also shows a negative pressure D detected by the controller 80 (e.g., a map sensor) with the air flow meter tentatively disposed upstream of the throttle valve 42.

As shown in FIG. 11, an amount of intake air that is actually drawn into the second cylinder chamber 12*b* of the engine 14 in intake strokes is indicated as peaks in the respective intake strokes, and an amount of intake air that is detected by the air flow meter 74 in the intake strokes is also indicated as peaks in the respective intake strokes. The times at which the amount of intake air is actually drawn into the second cylinder chamber 12*b* in the respective intake strokes and the times at which the amount of intake air in the bypass pipe 102 is detected by the air flow meter 74 in the respective intake strokes are in synchronism with each other. Specifically, the amount of intake air that is detected by the air flow meter 74 in each of the intake strokes is slightly smaller than the amount of intake air that is actually drawn into the second cylinder chamber 12*b* in each of the intake strokes.

The amount of intake air that is actually drawn into the second cylinder chamber 12*b* can simultaneously be detected highly accurately in real-time by the air flow meter 74 disposed in the bypass pipe 102. Specifically, the air flow meter 74 detects an amount of intake air flowing through the bypass pipe 102 that is connected to either one of the first through fourth branch pipes 36*a* through 36*d* in which no backward flow of intake air occurs, thereby detecting an amount of intake air that is actually drawn into the second cylinder chamber 12*b* highly accurately in real-time.

When the third piston 18*c* in the third cylinder C3 is displaced, intake air is drawn through the third branch pipe 36*c* into the third cylinder chamber 12*c*, and the rotational angle sensor 78 confirms the introduction of intake air into the third cylinder chamber 12*c*. Based on the value detected by the air flow meter 74, the controller 80 calculates the amount of intake air that is actually drawn into the third cylinder chamber 12*c*, and the injector 56 disposed in the third branch pipe 36*c* injects an amount of fuel based on the calculated amount of intake air.

Figure 12:
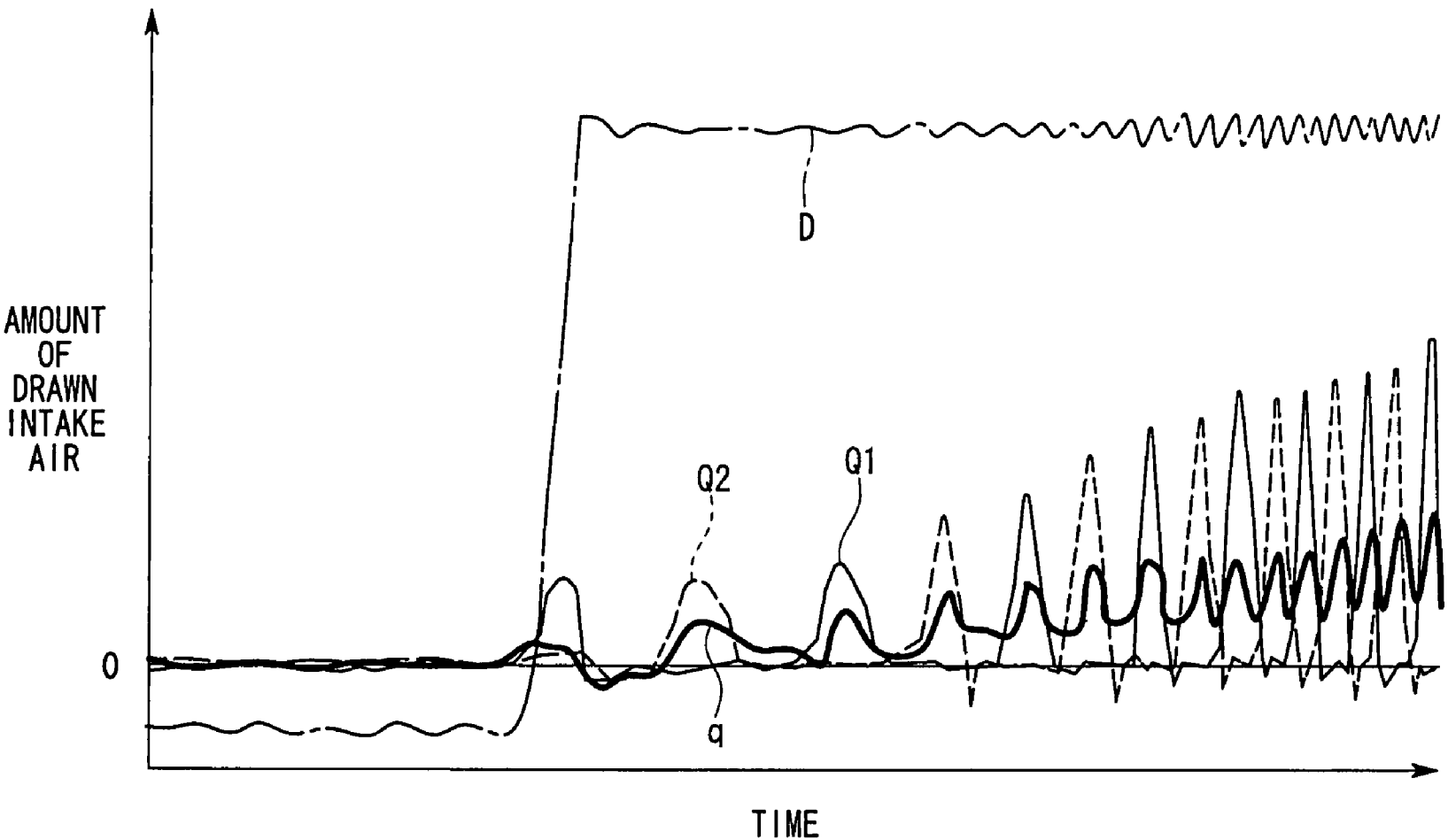
FIG. 12 is a diagram showing the relationship between amounts of intake air introduced into second and third cylinders of the internal combustion engine and time.

FIG. 12 shows the relationship between an amount Q1 of intake air that is actually introduced into the second cylinder C2, an amount Q2 of intake air that is actually introduced into the third cylinder C3, and an amount q of intake air detected by the air flow meter 74, per unit time, when the opening of the throttle valve 42 is rapidly increased in order to increase the engine output power.

As shown in FIG. 12, the amounts Q1, Q2 of intake air that are actually drawn into the second and third cylinder chambers 12*b*, 12*c* of the engine 14 in intake strokes are indicated as peaks in the respective intake strokes, and the amount q of intake air that is detected by the air flow meter 74 in the intake strokes is also indicated as peaks in the respective intake strokes. The times at which the amounts Q1, Q2 of intake air are actually drawn into the second and third cylinder chambers 12*b*, 12*c* in the respective intake strokes and the times at which the amount q of intake air in the bypass pipe 102 is detected by the air flow meter 74 in the respective intake strokes are in synchronism with each other.

Thus, amounts of intake air that are actually drawn into the second and third cylinder chambers 12*b*, 12*c* are detected simultaneously with high accuracy by the air flow meter 74.

When the first through fourth pistons 18*a* through 18*d* are successively displaced into the intake stroke in the respective first through fourth cylinder chambers 12*a* through 12*d*, a negative intake pressure is developed, introducing intake air from the throttle valve 42 into the intake manifold 34. The intake air then flows into either one of the first through fourth branch pipes 36*a* through 36*d*. At the same time, when a portion of the intake air flows into the bypass pipe 102 connected to the intake manifold 34, the air flow meter 74 detects the amount of intake air flowing through the bypass pipe 102.

The rotational angle sensor 78 outputs a detected signal to the controller 80, which determines which one of the first through fourth cylinders C1 through C4 is presently in the intake stroke based on the detected signal from the rotational angle sensor 78. When intake air is drawn from the second and third branch pipes 36*b*, 36*c*, to which the bypass pipe 102 is connected, into the second and third cylinder chambers 12*b*, 12*c*, the controller 80 calculates amounts of intake air that are actually drawn into the second and third cylinder chambers 12*b*, 12*c* based on the amounts of intake air detected by the air flow meter 74.

When intake air is drawn through the first and fourth branch pipes 36*a*, 36*d*, to which the bypass pipe 102 is not connected, the controller 80 can estimate amounts of intake air that are actually drawn into the first and fourth cylinder chambers 12*a*, 12*d* based on the amounts of intake air that were actually drawn into the second and third cylinder chambers 12*b*, 12*c* in the preceding intake stroke.

In the above description, the bypass pipe 102 is connected to the intake manifold 34 of the four-cylinder engine which has the four branch pipes, i.e., the first through fourth branch pipes 36*a* through 36*d*. However, the number of branch pipes and the number of engine cylinders are not limited to any values. In the intake system 100, the bypass pipe 102 may not be connected to the branch pipes 36*a*, 36*d* that are disposed adjacent to the side walls 58*a* of the tank 40 and disposed on the opposite ends of the intake manifold 34, but the bypass pipe 102 may be connected to the branch pipes 36*b*, 36*c* that are disposed centrally in the intake manifold 34 which are spaced from the side walls 58*a* of the tank 40.

According to the second embodiment, as described above, when the intake air flows along the side walls 58*a* of the tank 40 into the first and fourth branch pipes 36*a*, 36*d*, the intake air does not enter the bypass pipe 102 that is connected to the second and third branch pipes 36*b*, 36*c*. Specifically, since the second and third branch pipes 36*b*, 36*c*, to which the bypass pipe 102 is connected, are disposed centrally in the intake manifold 34 and spaced predetermined distances from the side walls 58*a* of the tank 40, the intake air flowing along the side walls 58*a* does not flow into the second and third branch pipes 36*b*, 36*c*. Accordingly, the intake air introduced into the tank 40 is prevented from flowing through the second connecting ends 70 back into the bypass pipe 102.

As a result, the air flow meter 74 is prevented from erroneously detecting an amount of intake air flowing back into the bypass pipe 102, and the air flow meter 74 highly accurately detects only a forward flow of intake air flowing downstream through the bypass pipe 102.

Amounts of intake air that are drawn into the first and fourth cylinder chambers 12*a*, 12*d* can be estimated based on the amounts of intake air that flow through the second and third branch pipes 36*b*, 36*c*, to which the bypass pipe 102 is connected, and also the amounts of intake air that are drawn into the second and third cylinder chambers 12*b*, 12*c*, because the bypass pipe 102 is not connected to the first and fourth cylinder chambers 12*a*, 12*d*. Therefore, the amount of intake air flowing through the bypass pipe 102 can be estimated simply and highly accurately based on the detected result from the air flow meter 74 without being affected by a backward intake air flow from the tank 40.

Furthermore, amounts of intake air that are actually drawn into the first through fourth cylinder chambers 12*a* through 12*d* can be estimated highly accurately based on the detected result from the air flow meter 74. Therefore, amounts of fuel to be injected can be controlled highly accurately based on the estimated amounts of intake air. As a consequence, it is possible to optimize the air-fuel ratio which is the ratio of the amounts of intake air drawn into the first through fourth cylinder chambers 12*a* through 12*d* to the amounts of fuel to be injected into the intake air. The engine 14 can be controlled highly accurately in real-time based on the amounts of intake air and the amounts of fuel to be injected.

Moreover, depending on the situation wherein the motor vehicle is driven, different amounts of intake air may be drawn into the respective first through fourth cylinder chambers 12*a* through 12*d*. In such a case, the differences between the amounts of intake air that are drawn into the second and third cylinder chambers 12*b*, 12*c*, which can be detected by the air flow meter 74, and the amounts of intake air that are drawn into the first and fourth cylinder chambers 12*a*, 12*d*, which can be estimated based on the amounts of intake air that are drawn into the second and third cylinder chambers 12*b*, 12*c*, are measured in advance in various operating conditions of the engine 14. Based on the measured differences, the amounts of drawn intake air that are detected by the air flow meter 74 are corrected depending on the actual driving state of the motor vehicle, for thereby estimating amounts of intake air to be drawn more accurately.

Because unburned gases and exhaust gases produced by the engine 14 do not flow back from the first and fourth branch pipes 36*a*, 36*d* through the bypass pipe 102, the detecting element 76 of the air flow meter 74 is prevented from being contaminated by those unburned gases and exhaust gases, and hence the detection accuracy of the air flow meter 74 for detecting the amount of intake air is prevented from being lowered.

Figure 13:
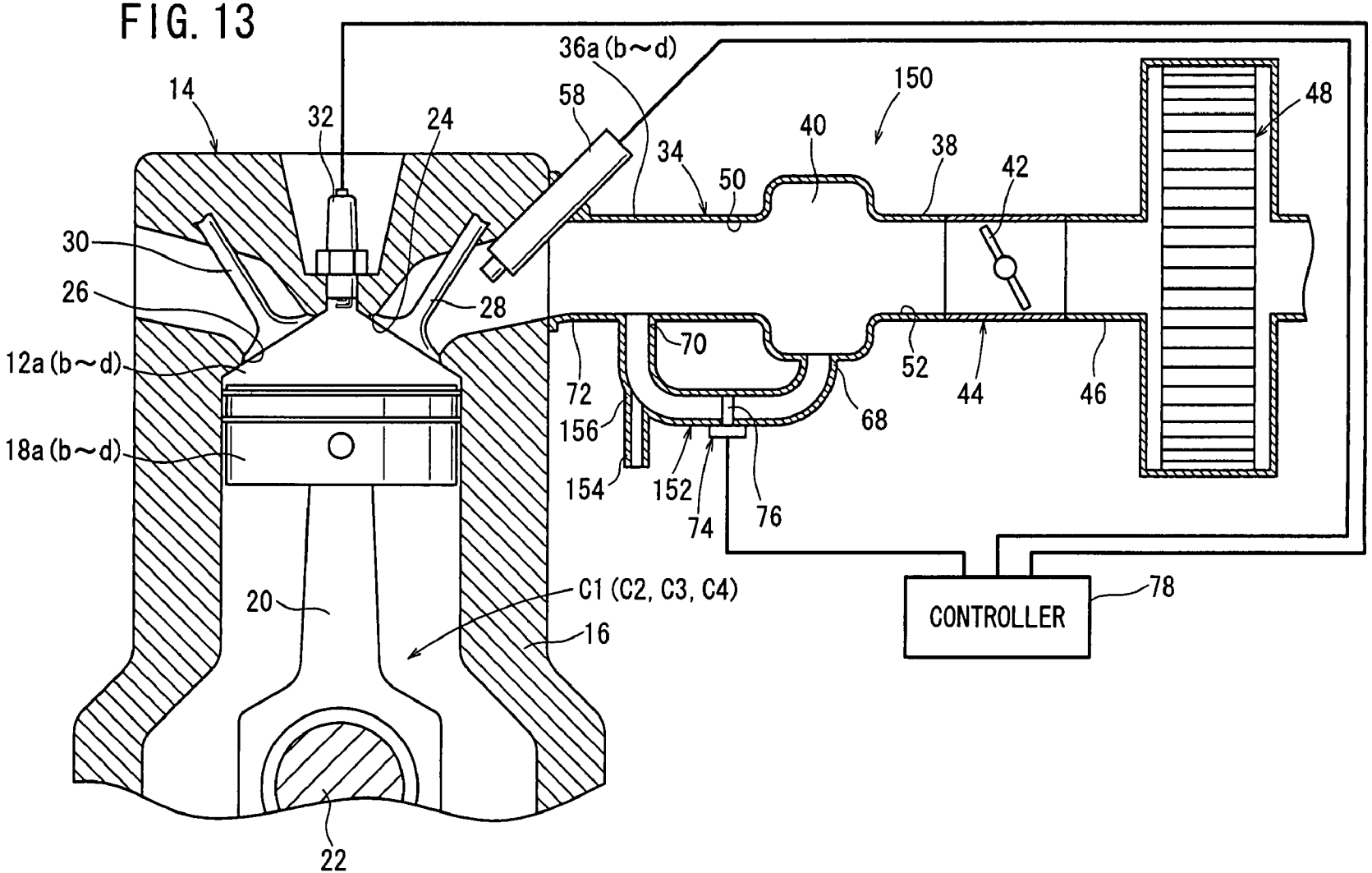
FIG. 13 is a schematic cross-sectional view, partly in block form, of an intake system for an internal combustion engine according to a third embodiment of the present invention.
Figure 14:
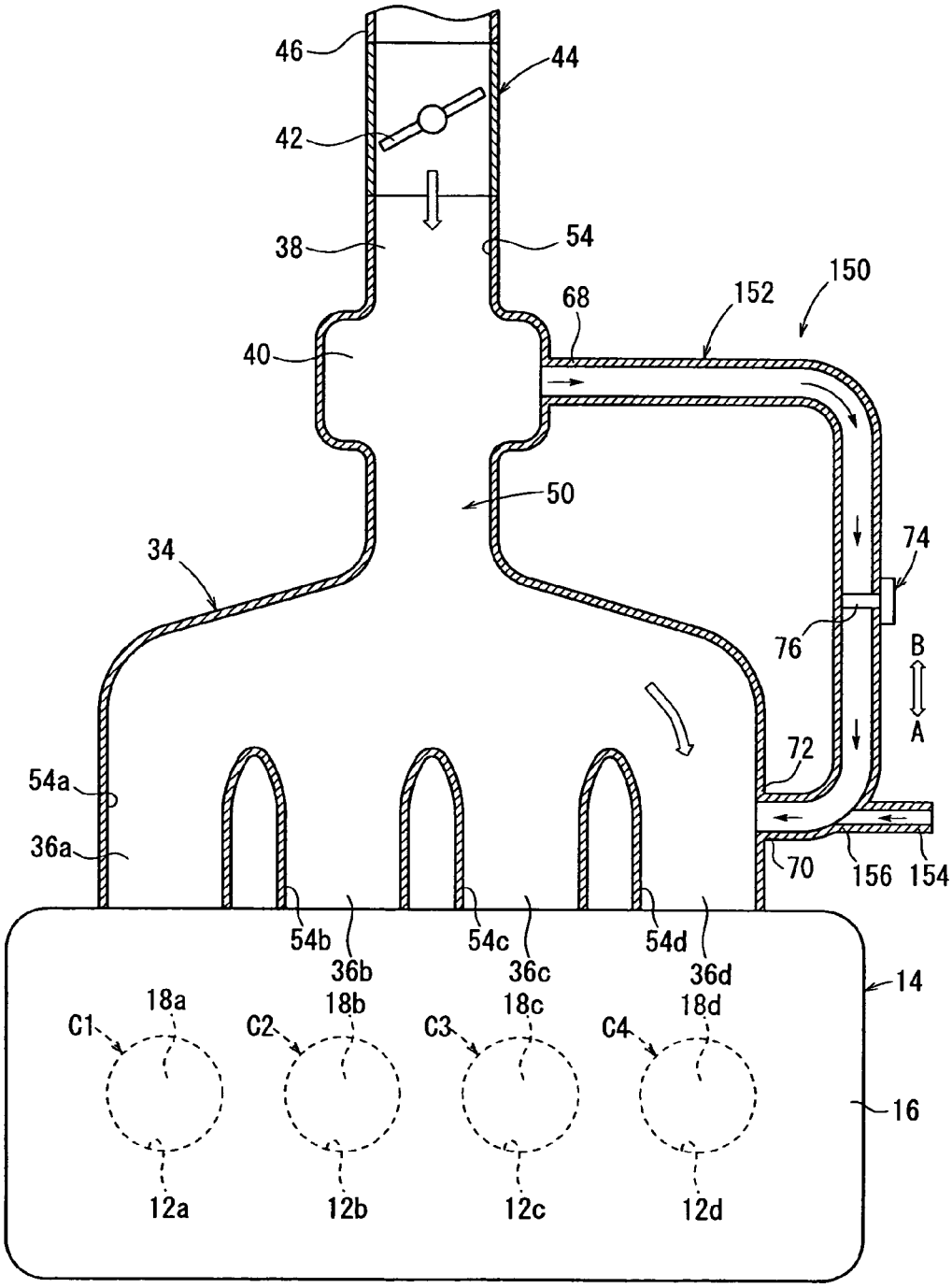
FIG. 14 is a horizontal cross-sectional view of a portion, including an intake manifold, of the intake system shown in FIG. 13.
Figure 15:
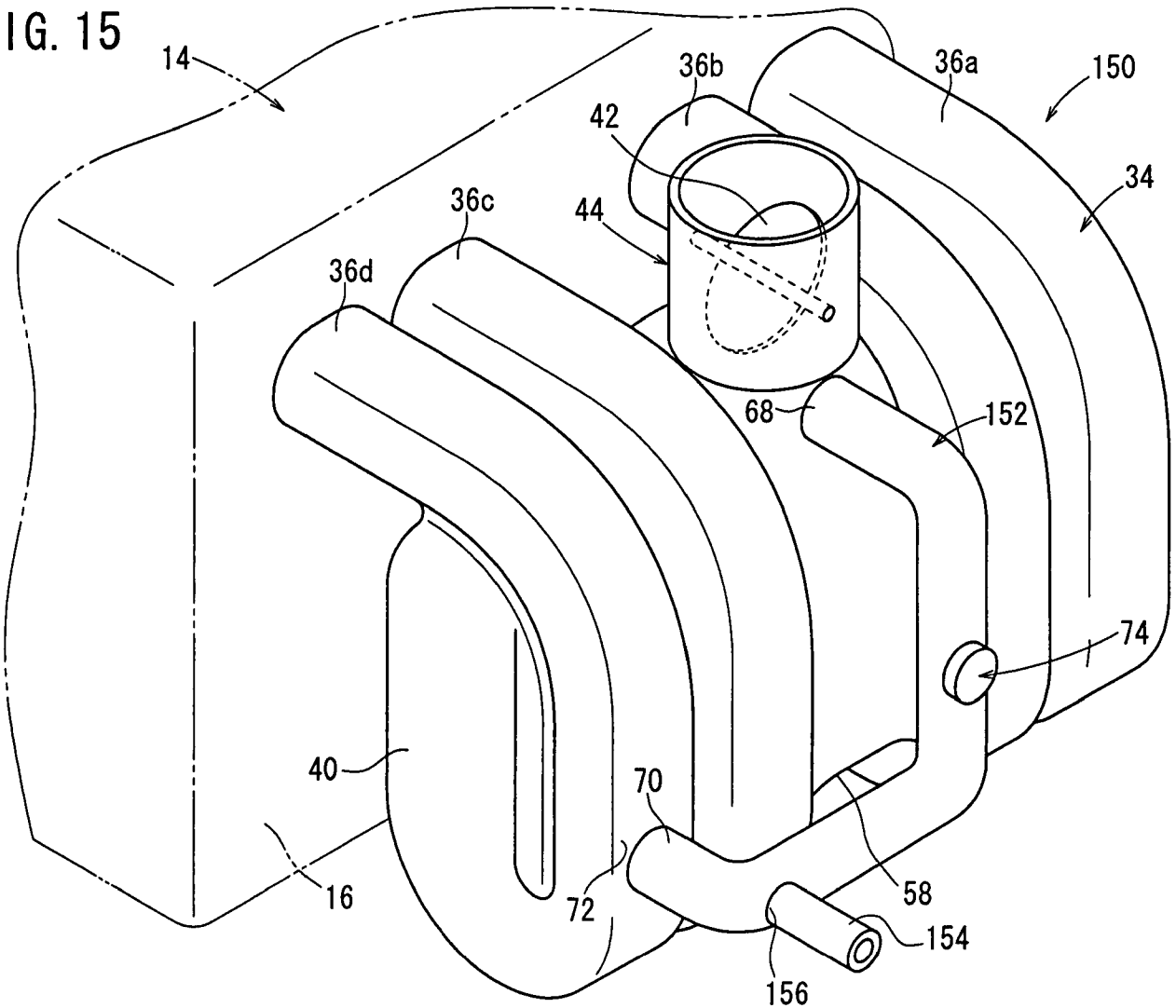
FIG. 15 is a perspective view of the intake manifold of the intake system shown in FIG. 13.
Figure 16:
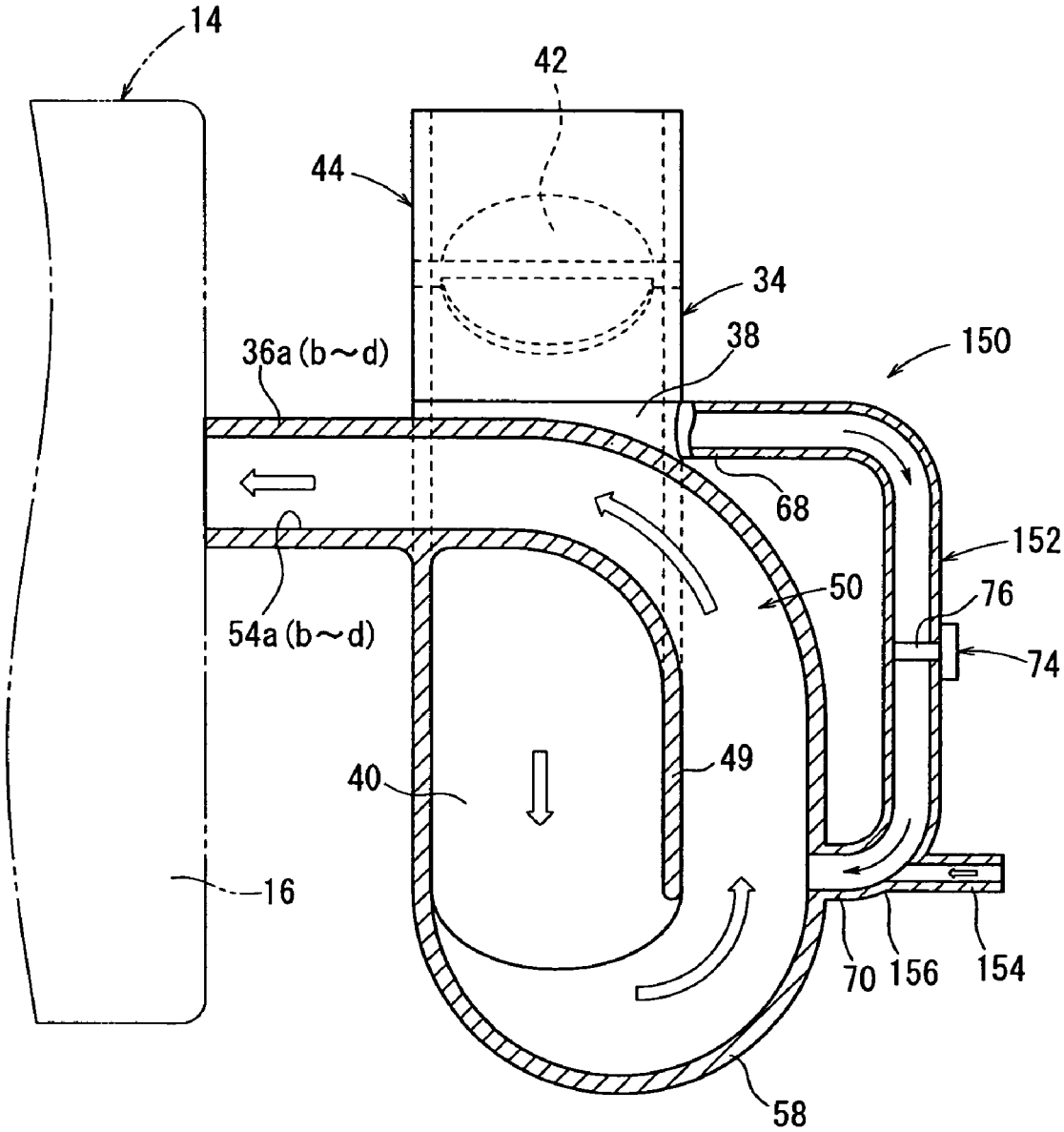
FIG. 16 is a vertical cross-sectional view of the intake system shown in FIG. 15.
Figure 17:
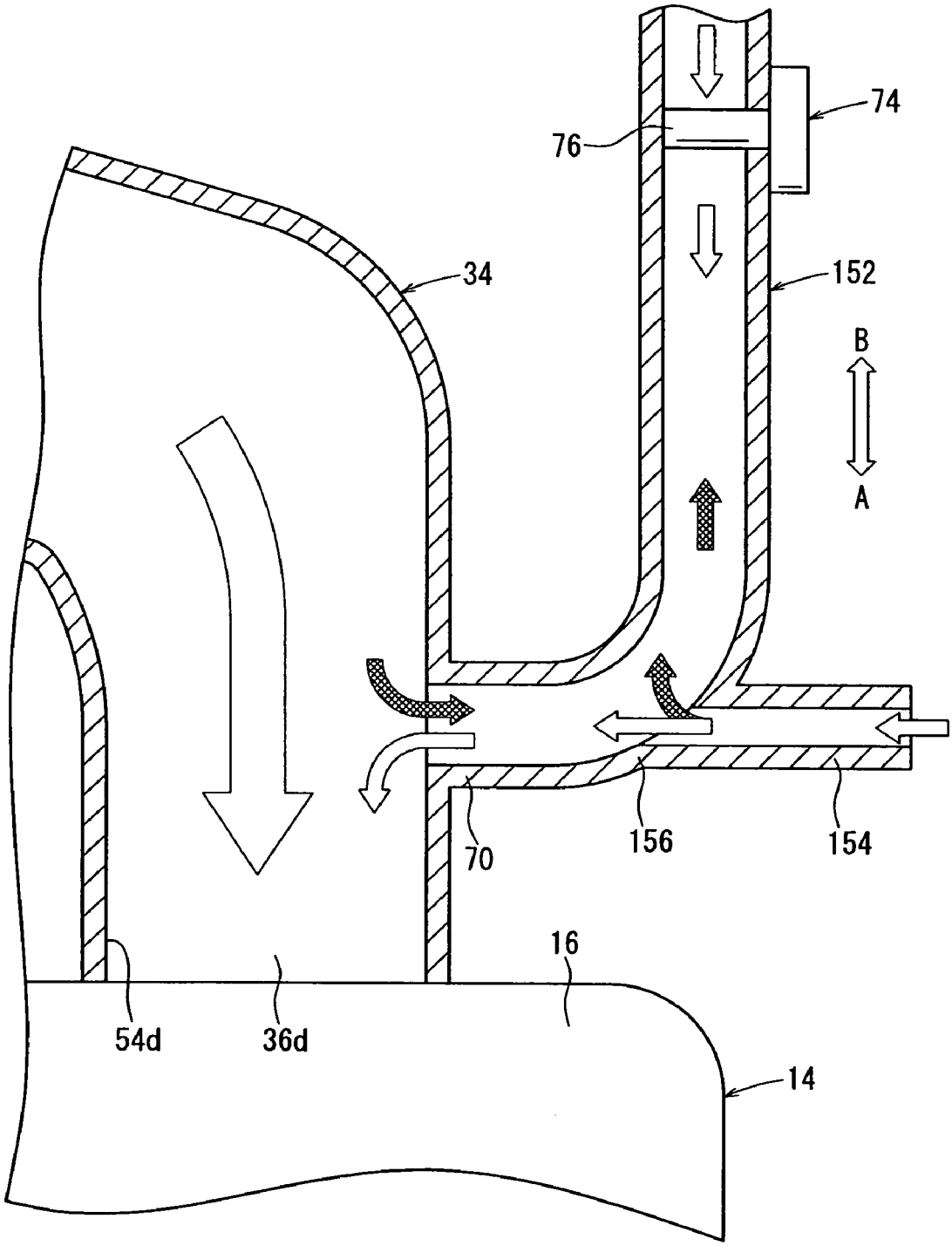
FIG. 17 is an enlarged vertical cross-sectional view of a joint between a bypass pipe and a fourth branch pipe shown in FIG. 16.

FIGS. 13 through 15 show an intake system 150 according to a third embodiment of the present invention. Those parts of the intake system 150 which are identical to those of the intake systems 10, 100 according to the first and second embodiments are denoted by identical reference characters, and such features shall not be described in detail below.

The intake system 150 according to the third embodiment differs from the intake systems 10, 100 according to the first and second embodiments in that a second connecting end 70 of a bypass pipe 152 is connected to only the fourth branch pipe 36*d* of the intake manifold 34, and an open pipe 154 that is externally open is connected to the bypass pipe 152 at a position somewhere between its opposite ends.

The bypass pipe 152 is connected to bypass the manifold section between the tank 40 and the fourth branch pipe 36*d*. The bypass pipe 152 has a first connecting end 68 connected to the tank 40 of the intake manifold 34, holding the tank 40 and the bypass pipe 152 in fluid communication with each other.

The bypass pipe 152 is bifurcated near its opposite end 70, providing a branch 156 extending substantially perpendicular to the axis of the bypass pipe 152. The branch 156 has a branched member extending as the second connecting end 70 toward the fourth branch pipe 36*d* and connected to the pipe wall 72 of the fourth branch pipe 36*d*. The branch 156 has another branched member extending as the open pipe 154 that is smaller in diameter than the second connecting end 70 and joined to the bypass pipe 152 to provide an external vent.

Stated otherwise, the open pipe 154 functions as an orifice for constricting, to a predetermined amount, an amount of intake air that is introduced from the external space through the open pipe 154 into the bypass pipe 152. The open pipe 154 that is smaller in diameter than the first connecting end 68 and the second connecting end 70 is effective to constrict an amount of intake air introduced from the external space into the bypass pipe 152 to a predetermined amount. Consequently, the amount of intake air that is detected by the air flow meter 74 can be reduced. The smaller-diameter open pipe 154 is also effective to reduce dust particles that are introduced from the external space through the open pipe 154 into the bypass pipe 152.

The bypass pipe 152 keeps the tank 40 and the branch passage 54*d* in the fourth branch pipe 36*d* in fluid communication with each other, and the open pipe 154 keeps the bypass pipe 152 vented to the atmosphere.

An air flow meter (amount-of-air detector) 74 for detecting an amount of intake air flowing through the bypass pipe 152 is disposed in the bypass pipe 152 between the first connecting end 68 and the branch 156. The air flow meter 74 functions as an amount-of-air detector.

The downstream second connecting end 70 of the bypass pipe 152 is not limited to being connected to the fourth branch pipe 36*d*, but may be connected to the first branch pipe 36*a*. With the downstream second connecting end 70 being connected to the first branch pipe 36*a*, the bypass pipe 152 is connected between the tank 40 and the first branch pipe 36*a*, holding the tank 40 and the branch passage 54*a* in the first branch pipe 36*a* in fluid communication with each other.

With the bypass pipe 152 being connected to the first branch pipe 36*a* and/or the fourth branch pipe 36*d*, the first branch pipe 36*a* and the fourth branch pipe 36*d* are disposed adjacent to the respective side walls 58*a* of the tank 40. Therefore, intake air that is introduced into the tank 40 may flow from the first branch pipe 36*a* and/or the fourth branch pipe 36*d* back into the bypass pipe 152. The second connecting end 70 of the bypass pipe 152 is thus connected to the first branch pipe 36*a* and/or the fourth branch pipe 36*d* from which intake air may possibly flow back into the bypass pipe 152.

Figure 18:
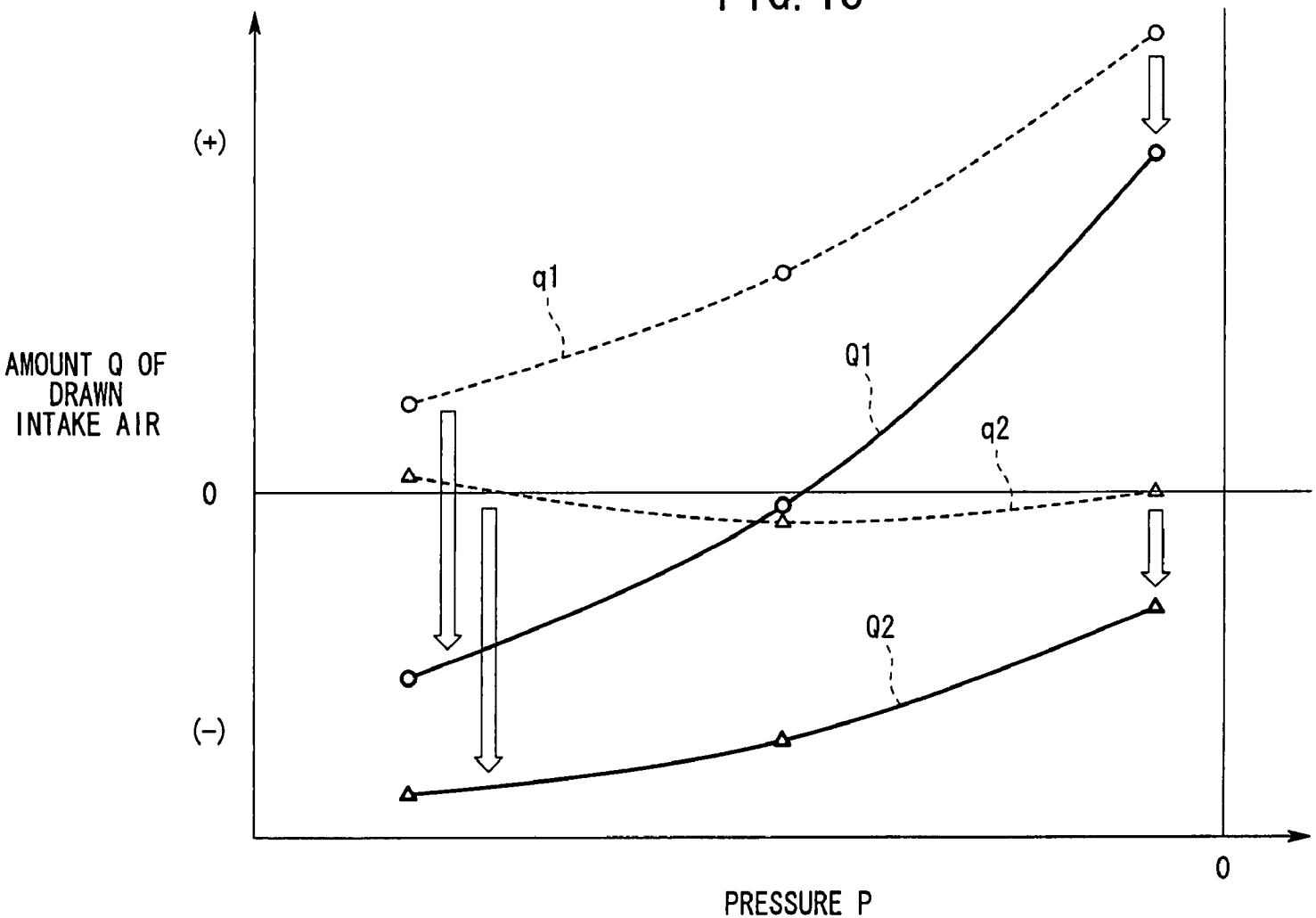
FIG. 18 is a diagram showing the relationship between an amount of intake air introduced into a fourth cylinder of the internal combustion engine and a pressure in the fourth branch pipe.

The backward flow of intake air from the tank 40 into the bypass pipe 152 has its rate increased in proportion to the opening of the throttle valve 42. For example, the relationship between the amount Q of intake air that flows through the bypass pipe 152 when the engine 14 operate at high and low rotational speeds, and the pressure P in the fourth branch pipe 36*d* to which the bypass pipe 152 is connected is shown in FIG. 18. It can be seen from FIG. 18 that when the throttle opening is increased to increase the pressure P in the fourth branch pipe 36*d*, i.e., when the negative pressure in the fourth branch pipe 36*d* approaches the atmospheric pressure, the amount Q of intake air that flow through the bypass pipe 152 does not increase in proportion to the pressure P, but remains substantially constant, i.e., substantially horizontal in FIG. 18 (see broken-line curves q1, q2).

Specifically, when the amount of intake air flowing back through the bypass pipe 152 increases, since it flows in the direction indicated by the arrow B which is opposite to the direction indicated by the arrow A along which a forward flow of intake air flows downstream through the bypass pipe 152, the amount of intake air flowing in the backward direction essentially cancels out the amount of intake air flowing in the forward direction. Consequently, the amount Q of intake air that flow through the bypass pipe 152 does not increase in proportion to the pressure P.

When the fourth piston 18*d* is displaced into the intake stroke in the fourth cylinder chamber 12*d*, a negative intake pressure is developed therein, introducing intake air from the air cleaner 48 into the intake manifold 34 (see FIG. 13). At the same time, part of the intake air introduced into the intake passage 50 in the intake manifold 34 flows from the tank 40 through the first connecting end 68 into the bypass pipe 152.

The part of the intake air flows through the bypass pipe 152 toward the second connecting end 70 in the direction indicated by the arrow A, whereupon the air flow meter 74 detects the amount of intake air flowing through the bypass pipe 152. The amount of intake air flowing as a forward flow downstream in the direction indicated by the arrow A through the bypass pipe 152 is detected as a positive value by the air flow meter 74.

Substantially at the same time, the intake air that is introduced into the tank 40 flows from the guide wall surface 58 along the side walls 58*a* of the tank 40 and then flows into the first and fourth branch pipes 36*a*, 36*d* adjacent to the side walls 58*a* (see FIG. 4). Therefore, the intake air flows through the fourth branch pipe 36*d* from the second connecting end 70 to the first connecting end 68 in the direction indicated by the arrow B. As the intake air flowing back upstream through the bypass pipe 152 flows in the direction opposite to the forward flow of intake air, the amount of the backward flow of intake air is detected as a negative value by the air flow meter 74.

When the fourth piston 18*d* is displaced, a negative pressure is also developed in the branch passage 54*d* in the fourth branch pipe 36*d*, drawing external air through the open pipe 154 as intake air into the bypass pipe 152. The intake air thus introduced through the open pipe 154 flows as a forward flow through the branch 156 toward the second connecting end 70, and also flows from the branch 156 back toward the first connecting end 68 in the direction indicated by the arrow B.

The intake air that is introduced through the open pipe 154 is thus divided into a flow from the branch 156 toward the second connecting end 70 and a flow from the branch 156 toward the first connecting end 68. Part of the intake air that flows toward the second connecting end 70 is combined with the intake air that flows from the first connecting end 68 to the second connecting end 70 in the direction indicated by the arrow A, and then introduced from the second connecting end 70 into the branch passage 54*d* in the fourth branch pipe 36*d*. At the same time, the intake air that flows from the branch 156 toward the first connecting end 68 in the direction indicated by the arrow B is combined with the intake air that flows from the fourth branch pipe 36*d* back into the bypass pipe 152, and flows toward the air flow meter 74 in the direction indicated by the arrow B.

Stated otherwise, the open pipe 154 that is open outwardly is connected to the bypass pipe 152 for introducing external air therethrough into the bypass pipe 152. The intake air introduced from the open pipe 154 is combined with the intake air that flows from the fourth branch pipe 36*d* through the second connecting end 70 upstream back into the bypass pipe 152, thereby increasing the amount of intake air flowing back through the bypass pipe 152.

As a result, the air flow meter 74 detects the amount of intake air flowing downstream forward in the direction indicated by the arrow A from the first connecting end 68 to the second connecting end 70, and also detects the amount of intake air flowing upstream backward in the direction indicated by the arrow B from the branch 156 to the first connecting end 68. Since the second and third branch pipes 36*b*, 36*c* are disposed centrally in the intake manifold 34 and spaced predetermined distances from the side walls 58*a* (see FIG. 4) of the tank 40, the intake air flowing along the side walls 58*a* does not enter from the tank 40 into the second and third branch pipes 36*b*, 36*c*.

FIG. 18 shows the relationship between the amount Q of intake air that flows through the bypass pipe 152 when the engine 14 operate at high and low rotational speeds, and the pressure P in the branch passage 54*d* in the fourth branch pipe 36*d*. In FIG. 18, the broken-line curves represent an amount q1 of drawn intake air that is detected by the air flow meter 74 when the engine 14 operates at a high rotational speed and an amount q2 of drawn intake air that is detected by the air flow meter 74 when the engine 14 operates at a low rotational speed, using an intake system wherein the open pipe 154 is not connected to the bypass pipe 152. The solid-line curves represent an amount Q1 of intake air drawn when the engine 14 operates at a high rotational speed and an amount Q2 of intake air drawn when the engine 14 operates at a low rotational speed, using the intake system 150 according to the present embodiment wherein the bypass pipe 152 having the open pipe 154 is connected between the tank 40 and the fourth branch pipe 36*d*.

A review of FIG. 18 indicates that since the first connecting end 68 of the bypass pipe 152 is connected to the tank 40 and the second connecting end 70 thereof is connected to the fourth branch pipe 36*d* to vent the bypass pipe 152 to the atmosphere through the open pipe 154, the amounts Q1, Q2 of intake air drawn when the engine 14 operates at high and low rotational speeds are lower as a whole than the amounts q1, q2 of intake air drawn employing the bypass pipe 152 that is free of the open pipe 154.

Specifically, when the pressure P in the branch passage 54*d* in the fourth branch pipe 36*d* is lower, i.e., the negative pressure in the fourth branch pipe 36*d* is higher, the amount Q of intake air introduced from the open pipe 154 into the bypass pipe 152 increases under the negative pressure. The intake air introduced from the open pipe 154 into the bypass pipe 152 is combined with the intake air flowing back from the fourth branch pipe 36*d*, so that the amount Q of intake air flowing back in the direction indicated by the arrow B which is detected by the air flow meter 74 increases.

As a result, since the amount of intake air flowing back is detected as a negative value by the air flow meter 74, the amount of intake air detected by the air flow meter 74 is greatly reduced.

When the throttle opening increases to increase the pressure P, the reduction in the amount of drawn intake air becomes smaller than if the bypass pipe 152 that is free of the open pipe 154 is employed. Stated otherwise, as the pressure in the branch passage 54*d* in the fourth branch pipe 36*d* increases, the amount of drawn intake air gradually approaches the amount of intake air drawn employing the bypass pipe 152 that is free of the open pipe 154.

The bypass pipe 152 having the open pipe 154 that is vented to the atmosphere is employed to connect the tank 40 and the fourth branch pipe 36*d* to each other. Therefore, when the pressure P in the branch passage 54*d* in the fourth branch pipe 36*d* is lower, the amount Q of intake air flowing through the bypass pipe 152 can be reduced by introducing external air from the open pipe 154 into the bypass pipe 152 to flow upstream back through the bypass pipe 152.

It can thus be seen that when the pressure P in the branch passage 54*d* in the fourth branch pipe 36*d* is lower, the amounts Q1, Q2 of intake air flowing through the bypass pipe 152 are greatly reduced, providing linear characteristics by which they gradually increase in proportion to the pressure P.

Even though the bypass pipe 152 is connected to the fourth branch pipe 36*d* which tends to introduce a backward flow of intake air into the bypass pipe 152, the open pipe 154 that is open outwardly which is connected to the bypass pipe 152 is effective to intentionally reduce the amount of intake air. Particularly, the amount of intake air drawn when the pressure P in the fourth branch pipe 36*d* is reduced to provide linear characteristics of intake air. As a consequence, it is possible to provide flow rate characteristics of intake air that are close to the amount of intake air that is actually drawn into the fourth cylinder chamber 12*d*.

The intake air flowing downstream through the bypass pipe 152 flows through the second connecting end 70 into the fourth branch pipe 36*d* of the intake manifold 34, and is then introduced into the fourth cylinder chamber 12*d*.

The air flow meter 74 outputs a detected signal, which is representative of the detected amount of intake air, to the controller 80, which calculates an optimum amount of fuel to be injected based on the detected signal. As the value detected by the air flow meter 74 is a predetermined amount smaller than the amount Q of intake air due to the external air introduced from the open pipe 154, the detected value is corrected by a preset corrective value.

The controller 80 then outputs a control signal based on the calculated amount of fuel to be injected to the injector 56. The injector 56 then injects the calculated amount of fuel into the intake air flowing through the intake passage 50 in the intake manifold 34 near the intake port 24. The mixture of the fuel and the intake air is now introduced into the fourth cylinder chamber 12*d*.

Even if the second connecting end 70 of the bypass pipe 152 is connected to the first branch pipe 36*a*, the intake stroke in which intake air is drawn into the first cylinder chamber 12*a* is the same as the intake stroke in which intake air is drawn into the fourth cylinder chamber 12*d*, and will not be described in detail below.

According to the third embodiment, as described above, the bypass pipe 152 is connected between the fourth branch pipe 36*d* which tends to introduce a backward flow of intake air into the bypass pipe 152 and the tank 40, and the open pipe 154 is connected through the branch 156 to the bypass pipe 152 to vent the bypass pipe 152 to the atmosphere.

Under a suction pressure applied from the fourth branch pipe 36*d*, external air is introduced from the open pipe 154 into the bypass pipe 152, and partly flows toward the second connecting end 70. Part of the introduced external air is also combined with intake air flowing from the fourth branch pipe 36*d* back into the bypass pipe 152 and flows back through the bypass pipe 152.

Therefore, the amount of intake air flowing upstream back in the bypass pipe 152 is increased. Since the intake air flowing upstream back in the bypass pipe 152 flows in the direction opposite to the direction in which intake air flows downstream forward in the bypass pipe 152, the amount of intake air detected by the air flow meter 74 is reduced. Particularly, the amount of drawn intake air is reduced when the pressure in the fourth branch pipe 36*d* is lower.

The intake system 150 thus provides linear characteristics wherein the amount of intake air detected by the air flow meter 74 gradually increases in proportion to the pressure in the fourth branch pipe 36*d*. Thus, it is possible to provide flow rate characteristics of intake air that are close to the amount of intake air that is actually drawn into the fourth cylinder chamber 12*d*, in the bypass pipe 152 that is connected to the fourth branch pipe 36*d* which tends to introduce a backward flow of intake air into the bypass pipe 152.

As a consequence, it is possible to control the amounts of fuel to be injected based on the amounts of intake air that are drawn into the first through fourth cylinder chambers 12*a* through 12*d* which are detected by the air flow meter 74, so that the engine 14 can be controlled highly accurately in real-time based on the amounts of intake air and the amounts of fuel to be injected.

Furthermore, by introducing external air through the open pipe 154 into the bypass pipe 152, unburned gases flowing from the engine 14 into the intake manifold 34 and exhaust gases flowing for exhaust gas recirculation are prevented from entering the bypass pipe 152. The detecting element 76 of the air flow meter 74 disposed in the bypass pipe 152 is thus prevented from becoming contaminated by those unburned gases and exhaust gases. The detection accuracy of the air flow meter 74 for detecting the amount of intake air is prevented from being lowered, and the air flow meter 74 has its durability increased.

The intake air that is introduced through the open pipe 154 into the bypass pipe 152 is cleaner than the intake air that flows through the intake passage 50 in the intake manifold 34 and the intake air that contains exhaust gases. Accordingly, the intake air that is introduced through the open pipe 154 keeps the interior of the bypass pipe 152 clean at all times.

Figure 19:
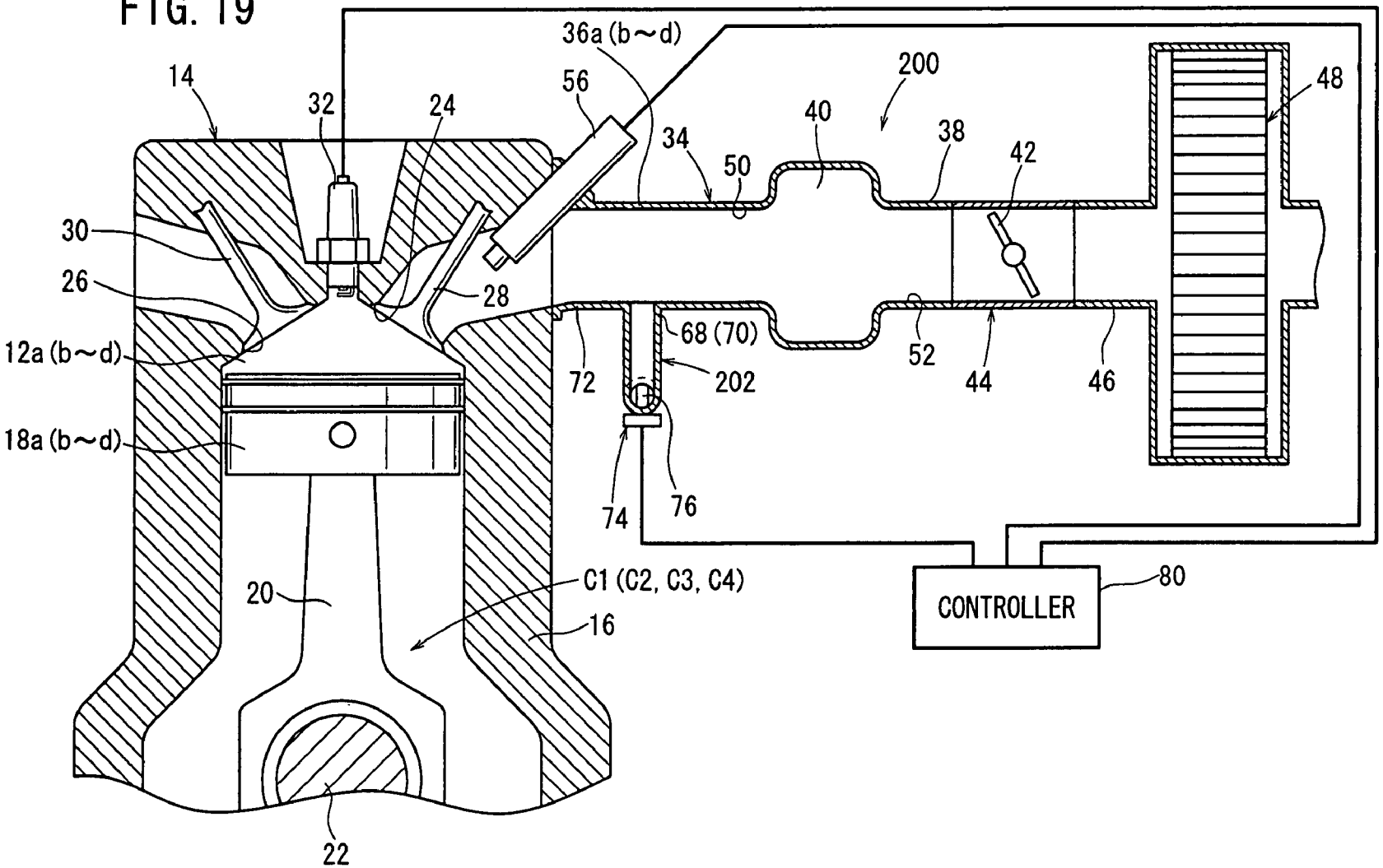
FIG. 19 is a schematic cross-sectional view, partly in block form, of an intake system for an internal combustion engine according to a fourth embodiment of the present invention.
Figure 20:
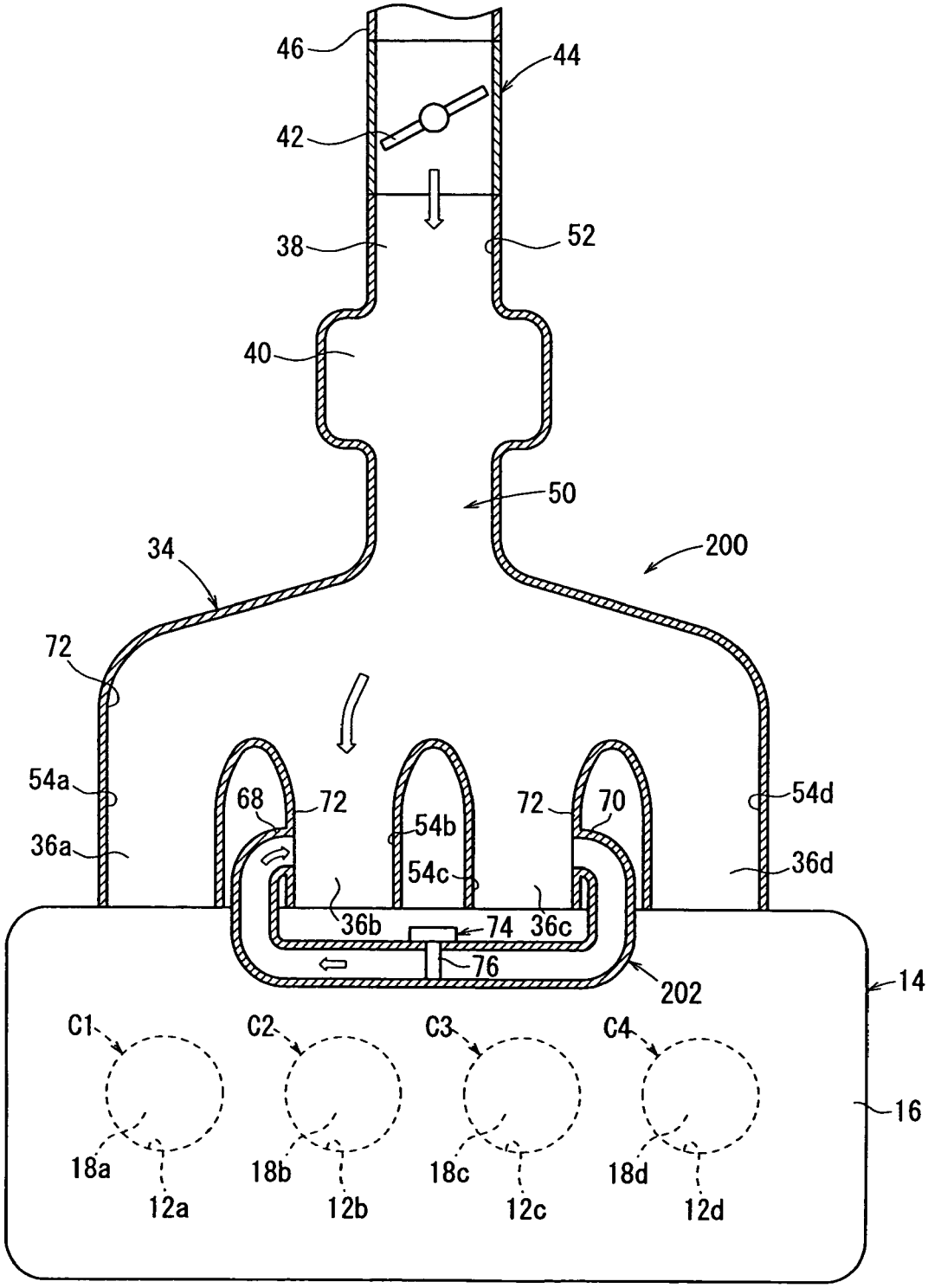
FIG. 20 is a horizontal cross-sectional view of a portion, including an intake manifold, of the intake system shown in FIG. 19.
Figure 21:
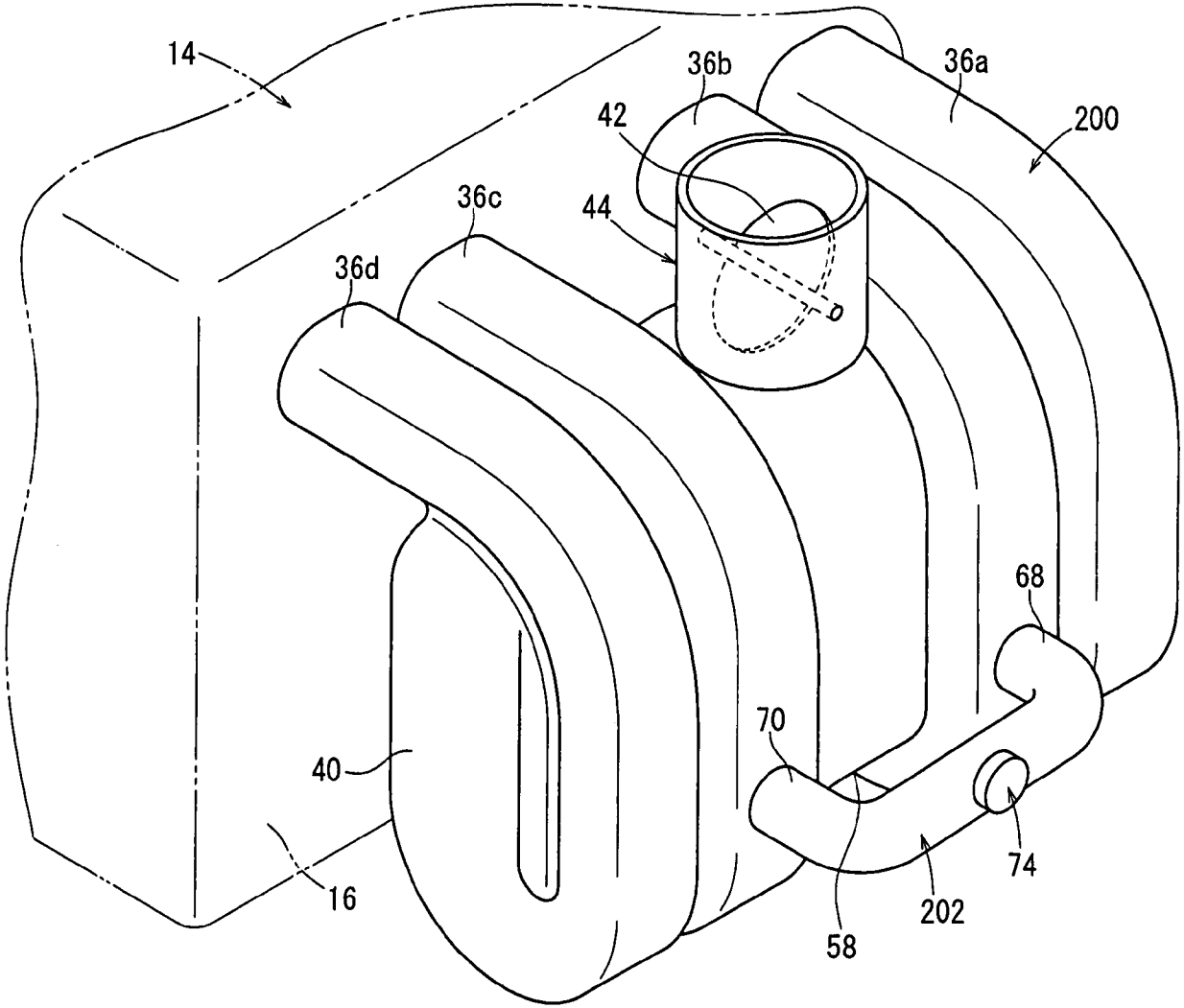
FIG. 21 is a perspective view of the intake manifold of the intake system shown in FIG. 19.

FIGS. 19 through 21 show an intake system 200 according to a fourth embodiment of the present invention. Those parts of the intake system 200 which are identical to those of the intake systems 10, 100, 150 according to the first, second, and third embodiments are denoted by identical reference characters, and such features shall not be described in detail below.

The intake system 200 according to the fourth embodiment differs from the intake systems 10, 100, 150 according to the first, second, and third embodiments in that a bypass pipe (auxiliary intake passage) 202 for bypassing the manifold section between the second and third branch pipes 36*b*, 36*c* is connected to the intake manifold 34.

The bypass pipe 202 bypasses the manifold section to keep only two, i.e., the second and third branch pipes 36*b*, 36*c* that are centrally located, of the substantially parallel first through fourth branch pipes 36*a* through 36*d* of the intake manifold 34, in fluid communication with each other.

The bypass pipe 202 has a first connecting end 68 connected to the pipe wall 72 of the second branch pipe 36*b*, keeping the branch passage 54*b* in the second branch pipe 36*b* and the bypass pipe 202 in fluid communication with each other. The bypass pipe 202 has a second connecting end 70 connected to the pipe wall 72 of the third branch pipe 36*c*, keeping the branch passage 54*c* in the third branch pipe 36*c* and the bypass pipe 202 in fluid communication with each other. Therefore, the bypass pipe 202 keeps the branch passage 54*b* in the second branch pipe 36*b* and the branch passage 54*c* in the third branch pipe 36*c* in fluid communication with each other.

An air flow meter 74 for detecting an amount of intake air flowing through the bypass pipe 202 is disposed in the bypass pipe 202. The air flow meter 74 functions as an amount-of-air detector.

Intake air is introduced through the common pipe 38 of the intake manifold 34 into the tank 40, and flows along the side walls 58*a* (see FIG. 4) of the tank 40 into the first and fourth branch pipes 36*a*, 36*d* adjacent to the side walls 58*a*. Therefore, the intake air may flow from either one of the first and fourth branch pipes 36*a*, 36*d* back into the bypass pipe 202 when the bypass pipe 202 is connected to the first and fourth branch pipes 36*a*, 36*d*.

With the intake system 200, the bypass pipe 202 is connected between only the second branch pipe 36*b* and the third branch pipe 36*c* that are positioned centrally in the intake manifold 34 and spaced from the side walls 58*a* of the tank 40. Therefore, even when the intake air from the tank 40 is introduced into the first and fourth branch pipes 36*a*, 36*d*, the second and third branch pipes 36*b*, 36*c* to which the bypass pipe 202 is connected are not affected by the backward flow of intake air, allowing the air flow meter 74 to detect the amount of intake air stably.

The bypass pipe 202 may be connected between the first and fourth branch pipes 36*a*, 36*d* which tend to introduce a backward flow of intake air.

According to such an alternative layout, the amount of intake air flowing from the first branch pipe 36*a* back into the bypass pipe 202 and the amount of intake air flowing from the fourth branch pipe 36*d* back into the bypass pipe 202 are substantially the same as each other, but flows in opposite directions. Therefore, the amount of intake air flowing from the first branch pipe 36*a* back into the bypass pipe 202 and the amount of intake air flowing from the fourth branch pipe 36*d* back into the bypass pipe 202 cancel each other, and the air flow meter 74 can accurately detects the amount of intake air flowing through the bypass pipe 202.

With the intake system 200, when the second cylinder C2 that is constructed of the second piston 18*b* and the second cylinder chamber 12*b* is in the intake stroke, intake air flows into the branch passage 54*b* in the second branch pipe 36*b* and is drawn into the second cylinder chamber 12*b* as the second piston 18*b* is displaced in its stroke. At this time, a negative pressure is developed in the branch passage 54*b* in the second branch pipe 36*b* by the second piston 18*b* as it is displaced in the second cylinder chamber 12*b*. Intake air in the third branch pipe 36*c* is drawn through the bypass pipe 202 connected to the second branch pipe 36*b*, and flows through the bypass pipe 202 from the second connecting end 70 to the first connecting end 68 in the direction indicated by the arrow A.

The amount of intake air thus flowing through the bypass pipe 202 is detected by the air flow meter 74 disposed in the bypass pipe 202. The intake air is then introduced through the first connecting end 68 of the bypass pipe 202 into the branch passage 54*b* in the second branch pipe 36*b*, and drawn into the second cylinder chamber 12*b*.

When the third cylinder C3 that is constructed of the third piston 18*c* and the third cylinder chamber 12*c* is then in the intake stroke, intake air flows into the branch passage 54*c* in the third branch pipe 36*c* and is drawn into the third cylinder chamber 12*c* as the third piston 18*c* is displaced in its stroke.

At this time, a negative pressure is developed in the branch passage 54*c* in the third branch pipe 36*c* by the third piston 18*c* as it is displaced in the third cylinder chamber 12*c*. Intake air in the second branch pipe 36*b* is drawn through the bypass pipe 202 connected to the third branch pipe 36*c*, and flows through the bypass pipe 202 from the first connecting end 68 to the second connecting end 70 in the direction indicated by the arrow B.

Figure 22:
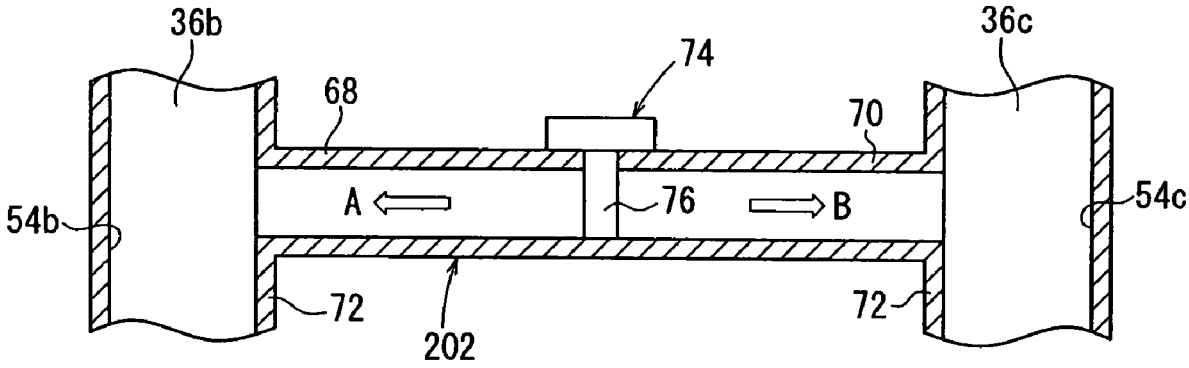
FIG. 22 is a cross-sectional view of a bypass pipe shown in FIG. 20 which is illustrated as a straight bypass pipe.
Figure 23:
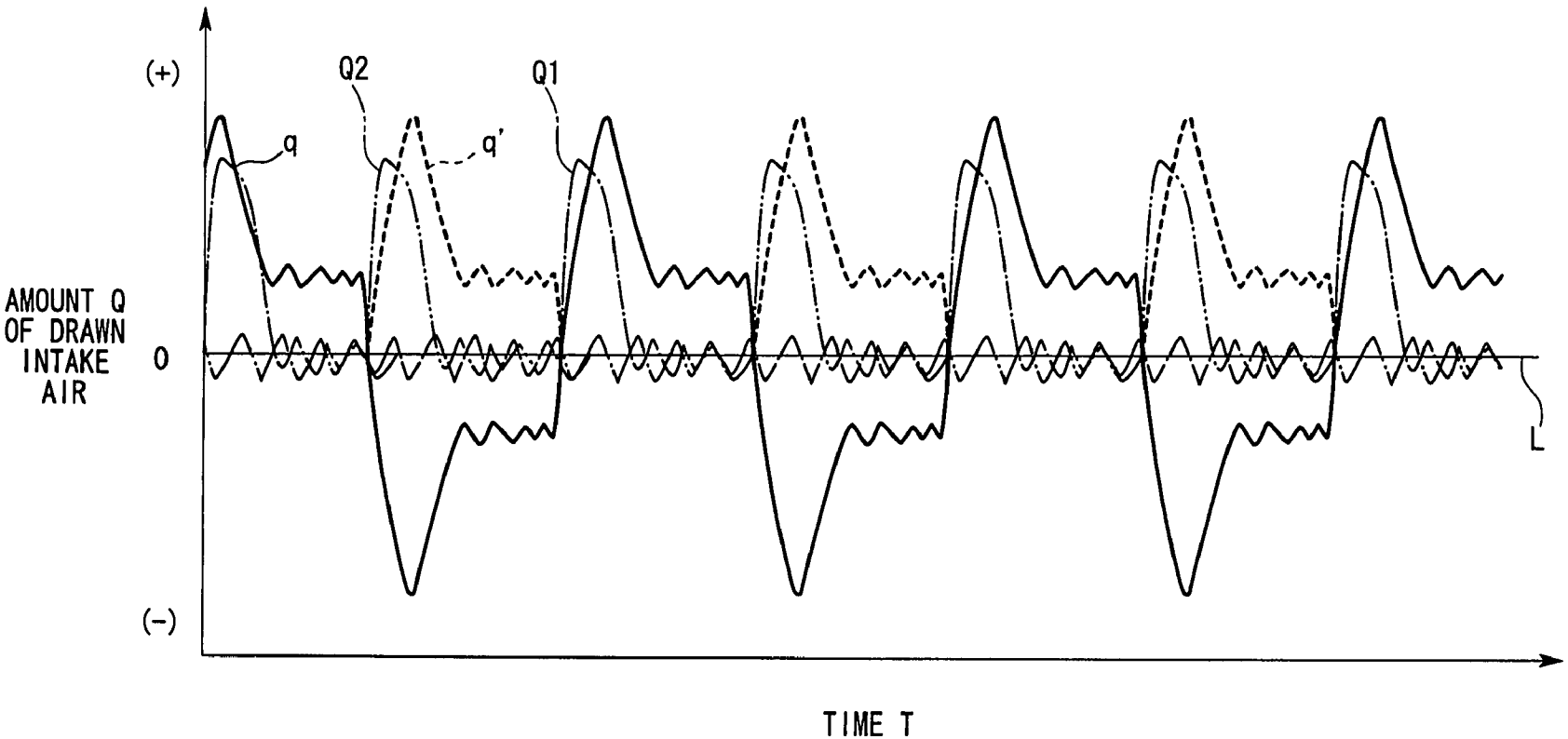
FIG. 23 is a diagram showing the relationship between amounts of intake air that are actually introduced into second and third cylinders of the internal combustion engine, amounts of intake air that are detected by an air flow meter, and time.

As shown in FIG. 22, the direction indicated by the arrow A in which the intake air flows through the bypass pipe 202 when the second cylinder C2 is in the intake stroke and the direction indicated by the arrow B in which the intake air flows through the bypass pipe 202 when the third cylinder C3 is in the intake stroke are opposite to each other. Therefore, as shown in FIG. 23, the amount of intake air that is detected by the air flow meter 74 has alternately positive and negative values that are inverted with respect to a reference line L where the amount of intake air is nil.

When the amount q of intake air detected by the air flow meter 74 when the second cylinder C2 is in the intake stroke has a positive value, for example, the amount q of intake air detected by the air flow meter 74 when the third cylinder C3 is in the intake stroke has a negative value. As a result, the controller 80 inverts the detected value based on the amount Q2 of intake air flowing through the third branch pipe 36*c*, and calculates an amount of intake air actually flowing through the third branch pipe 36*c* based on the inverted value (see broken line curve in FIG. 23).

The controller 80 thus calculates the amount of intake air actually flowing through the third branch pipe 36*c* and also an optimum amount of fuel to be injected with respect to the calculated amount of intake air. The controller 80 then outputs a control signal based on the calculated optimum amount of fuel to be injected to the injector 56 disposed in the third branch pipe 36*c*.

The relationship between an amount Q1 of intake air (indicated by the dot-and-dash-line curve in FIG. 23) that is actually drawn into the second cylinder C2, an amount Q2 of intake air (indicated by the two-dot-and-dash-line curve in FIG. 23) that is actually drawn into the third cylinder C3, and an amount q of intake air detected by the air flow meter 74, per unit time T, will be described below with reference to FIG. 23.

It can be seen from FIG. 23 that the amounts Q1, Q2 of intake air that are actually drawn into the second and third cylinders C2, C3 in intake strokes are indicated as peaks in the respective intake strokes, and the amount q of intake air that is detected by the air flow meter 74 in the intake strokes is also indicated as peaks in the respective intake strokes. The times at which the amounts Q1, Q2 of intake air are actually drawn into the second and third cylinder chambers 12*b*, 12*c* in the respective intake strokes and the times at which the amount q of intake air in the bypass pipe 202 is detected by the air flow meter 74 in the respective intake strokes are in synchronism with each other.

The amount of intake air detected by the air flow meter 74, which is of a negative value, is inverted with respect to the reference line L, and hence is represented by the broken-line curve q'. It can thus be understood that the values of the amounts of intake air detected as peaks by the air flow meter 74 are detected as essentially equivalent to the amounts Q1, Q2 of intake air that are actually drawn into the second and third cylinders C2, C3 and output as peaks.

The amounts of intake air that are actually drawn into the second and third cylinder chambers 12*b*, 12*c*, for example, can thus be detected simultaneously in real-time as substantially equivalent values highly accurately by the air flow meter 74 disposed in the bypass pipe 202. The amounts of intake air that are actually drawn into the second and third cylinder chambers 12*b*, 12*c* can be detected highly accurately in real-time by the air flow meter 74 that detects the amount of intake air flowing through the bypass pipe 202 connected between the second branch pipe 36*b* and the third branch pipe 36*c* of the intake manifold 34.

In the above description, the bypass pipe 202 is connected between the second branch pipe 36*b* and the third branch pipe 36*c* of the intake manifold 34 of the four-cylinder engine 14. However, the number of branch pipes and the number of engine cylinders are not limited to any values.

According to the fourth embodiment, as described above, the bypass pipe 202 is connected between the second branch pipe 36*b* and the third branch pipe 36*c* which are not affected by a backward flow of intake air from the intake manifold 34, and the air flow meter 74 is disposed in the bypass pipe 202. Therefore, the air flow meter 74 disposed in the single bypass pipe 202 is capable of detecting an amount of intake air flowing through the second branch pipe 36*b* to which one end of the bypass pipe 202 is connected and an amount of intake air flowing through the third branch pipe 36*c* to which the other end of the bypass pipe 202 is connected.

With the simple arrangement in which the single bypass pipe 202 having the air flow meter 74 is connected between the second branch pipe 36*b* and the third branch pipe 36*c*, amounts of intake air that are drawn through the second branch pipe 36*b* and the third branch pipe 36*c* into the engine 14 can be detected highly accurately. The cost of the intake system 200 is therefore relatively low.

Of the first through fourth branch pipes 36*a* through 36*d*, the bypass pipe 202 may be connected between the branch pipes which tend to be affected by a backward flow of intake air from the intake manifold 34, i.e., the first branch pipe 36*a* and the fourth branch pipe 36*d*. With this layout, amounts of intake air that are drawn through the first branch pipe 36*a* and the fourth branch pipe 36*d* into the engine 14 can be detected highly accurately.

Specifically, of the first through fourth branch pipes 36*a* through 36*d*, the branch pipes for allowing intake air introduced into the bypass pipe 202 to flow under the same conditions, e.g., the same backward flows of intake air, are connected to each other by the bypass pipe 202. The single air flow meter 74 disposed in the bypass pipe 202 can highly accurately detect amounts of intake air drawn into the engine 14, and the controller 80 can highly accurately control amounts of fuel to be injected based on the detected amounts of intake air. It is thus possible to optimize the air-fuel ratio which is the ratio of the intake air drawn into the engine 14 to the amount of fuel to be injected into the intake air. The engine 14 can be controlled highly accurately in real-time based on the amount of intake air and the amount of fuel to be injected.

Although certain preferred embodiments of the present invention have been shown and described in detail, it should be understood that various changes and modifications may be made therein without departing from the scope of the appended claims.

What is claimed is:

1. An intake system for use in an internal combustion engine, comprising:

an intake manifold connected to a main body of the internal combustion engine and a main intake passage defined therein;

said intake manifold having a plurality of parallel branch pipes and a common pipe connected to said branch pipes;

a throttle valve connected to said common pipe and openable and closable for regulating an amount of intake air drawn through said main intake passage into the internal combustion engine; and an injector for injecting an amount of fuel depending on the regulated amount of intake air drawn into the internal combustion engine, wherein said intake manifold further comprises an auxiliary intake passage disposed separately from said main intake passage and connected to at least one of said parallel branch pipes in fluid communication with said main intake passage, and an amount-of-air detector mounted downstream of said throttle valve and disposed in said auxiliary intake passage for detecting an amount of intake air drawn into the internal combustion engine.

2. An intake system for use in an internal combustion engine, comprising:

an intake manifold connected to a main body of the internal combustion engine and a main intake passage defined therein;

said intake manifold having a plurality of parallel branch pipes and a common pipe connected to said branch pipes;

a throttle valve connected to said common pipe and openable and closable for regulating an amount of intake air drawn through said main intake passage into the internal combustion engine; and an injector for injecting an amount of fuel depending on the regulated amount of intake air drawn into the internal combustion engine, wherein said intake manifold further comprises an auxiliary intake passage disposed separately from said main intake passage and connected to at least one of said parallel branch pipes in fluid communication with said main intake passage, and an amount-of-air detector mounted downstream of said throttle valve and disposed in said auxiliary intake passage for detecting an amount of intake air drawn into the internal combustion engine, wherein said auxiliary intake passage comprises a plurality of branches associated respectively with said branch pipes and having at least two different passage diameters, and a common joint joined to said branches, said branches being connected respectively to said branch pipes.

3. An intake system according to claim 2, wherein one of said branch pipes which is disposed in at least one of ends of said intake manifold is disposed in a position along a flow of intake air flowing out of said common pipe, and one of said branches, which is connected to said one of the branch pipes, which is disposed in at least one of the ends of said intake manifold, has a passage diameter smaller than another of said branches.

4. An intake system for use in an internal combustion engine, comprising:

an intake manifold connected to a main body of the internal combustion engine and a main intake passage defined therein;

said intake manifold having a plurality of parallel branch pipes and a common pipe connected to said branch pipes;

a throttle valve connected to said common pipe and openable and closable for regulating an amount of intake air drawn through said main intake passage into the internal combustion engine; and an injector for injecting an amount of fuel depending on the regulated amount of intake air drawn into the internal combustion engine, wherein said intake manifold further comprises an auxiliary intake passage disposed separately from said main intake passage and connected to at least one of said parallel branch pipes in fluid communication with said main intake passage, and an amount-of-air detector mounted downstream of said throttle valve and disposed in said auxiliary intake passage for detecting an amount of intake air drawn into the internal combustion engine, wherein said auxiliary intake passage is connected to at least one of said branch pipes which is not disposed in ends of said intake manifold, and those of said branch pipes which are disposed in the respective ends of said intake manifold are disposed in a position along a flow of intake air flowing out of said common pipe.

5. An intake system according to claim 4, wherein said auxiliary intake passage comprises a plurality of branches connected to corresponding ones of the branch pipes of said intake manifold, and a common joint joined to said branches and connected to said common pipe.

6. An intake system for use in an internal combustion engine, comprising:

an intake manifold connected to a main body of the internal combustion engine and a main intake passage defined therein;

said intake manifold having a plurality of parallel branch pipes and a common pipe connected to said branch pipes;

a throttle valve connected to said common pipe and openable and closable for regulating an amount of intake air drawn through said main intake passage into the internal combustion engine; and an injector for injecting an amount of fuel depending on the regulated amount of intake air drawn into the internal combustion engine, wherein said intake manifold further comprises an auxiliary intake passage disposed separately from said main intake passage and connected to at least one of said parallel branch pipes in fluid communication with said main intake passage, and an amount-of-air detector mounted downstream of said throttle valve and disposed in said auxiliary intake passage for detecting an amount of intake air drawn into the internal combustion engine, wherein said auxiliary intake passage is connected between at least one of those of said branch pipes which is disposed in respective ends of said intake manifold, and provides fluid communication between said main intake passage and an external space.

7. An intake system according to claim 6, wherein said auxiliary intake passage comprises:

a first connecting end connected to said common pipe;

a second connecting end connected to those of said branch pipes which are in at least one of ends of said intake manifold; and an opening defined between said first connecting end and said second connecting end downstream of said amount-of-air detector and providing fluid communication between said auxiliary intake passage and an external space;

said opening having a passage diameter smaller than said first connecting end and said second connecting end.

8. An intake system according to claim 1, wherein said auxiliary intake passage is connected between two of said branch pipes which are disposed centrally in said intake manifold.

* * * * *